US011896891B2

(12) United States Patent
Scheper et al.

(10) Patent No.: US 11,896,891 B2
(45) Date of Patent: Feb. 13, 2024

(54) CARD-HANDLING DEVICES AND RELATED METHODS, ASSEMBLIES, AND COMPONENTS

(71) Applicant: SG Gaming, Inc., Las Vegas, NV (US)

(72) Inventors: Paul K Scheper, Bloomington, MN (US); Ronald R. Swanson, Otsego, MN (US); James B. Stasson, Chaska, MN (US); James P. Helgesen, Eden Prairie, MN (US); Haven A. Mercer, Excelsior, MN (US); Troy D. Nelson, Big Lake, MN (US); Jamal Hani Kotifani, Eden Prairie, MN (US); Feraidoon Bourbour, Eden Prairie, MN (US); Peter Krenn, Neufeld (AT)

(73) Assignee: SG Gaming, Inc., Las Vegas, NV (US)

( * ) Notice: Subject to any disclaimer, the term of this patent is extended or adjusted under 35 U.S.C. 154(b) by 605 days.

(21) Appl. No.: 16/132,090

(22) Filed: Sep. 14, 2018

(65) Prior Publication Data

US 2020/0086203 A1 Mar. 19, 2020

(51) Int. Cl.
*A63F 1/12* (2006.01)
*A63F 1/06* (2006.01)

(52) U.S. Cl.
CPC ..... *A63F 1/12* (2013.01); *A63F 1/062* (2013.01); *A63F 1/067* (2013.01)

(58) Field of Classification Search
CPC ..... A63F 1/14; A63F 1/12
See application file for complete search history.

(56) References Cited

U.S. PATENT DOCUMENTS 130,281 A 8/1872 Coughlin
205,030 A 6/1878 Ash
(Continued)

FOREIGN PATENT DOCUMENTS

AU 2383667 A 1/1969
AU 5025479 A1 3/1980
(Continued)

OTHER PUBLICATIONS

DVD labeled Exhibit 1. This is a DVD taken by Shuffle Master personnel of the live operation of a CARD One2Sil Shuffler (Oct. 7, 2003). DVD sent to Examiner by US Postal Service with this PTO/SB/08 form.

(Continued)

*Primary Examiner* — Eugene L Kim
*Assistant Examiner* — Christopher Glenn
(74) *Attorney, Agent, or Firm* — TraskBritt

(57) ABSTRACT

Card-handling devices may include a card-shuffling apparatus, a card output portion, and/or a card input portion. The card input portion may include a card rotation device. The card rotation device may be configured to receive and rotate cards about a minor axis of the cards. The card-handling device may include a card-shuffling apparatus including a carousel having at least one hundred compartments each configured to hold between one and ten cards and arranged radially about the carousel. The card-handling device may be positioned at a gaming structure with a playing surface. The card-handling device may include a card output portion for receiving shuffled cards from the card-shuffling apparatus. The card output portion may be configured to receive the cards where major faces of the playing cards are oriented in a plane substantially transverse to the playing surface.

26 Claims, 12 Drawing Sheets

(56) References Cited

U.S. PATENT DOCUMENTS

| | | | |
|---|---|---|---|
| 609,730 | A | 8/1898 | Booth |
| 673,154 | A | 4/1901 | Bellows |
| 793,489 | A | 6/1905 | Williams |
| 892,389 | A | 7/1908 | Bellows |
| 1,014,219 | A | 1/1912 | Hall |
| 1,043,109 | A | 11/1912 | Hurm |
| 1,157,898 | A | 10/1915 | Perret |
| 1,256,509 | A | 2/1918 | Belknap |
| 1,380,898 | A | 6/1921 | Hall |
| 1,556,856 | A | 10/1925 | Lipps |
| 1,757,553 | A | 5/1930 | Tauschek |
| 1,850,114 | A | 3/1932 | McCaddin |
| 1,885,276 | A | 11/1932 | McKay |
| 1,889,729 | A | 11/1932 | Hammond |
| 1,955,926 | A | 4/1934 | Matthaey |
| 1,992,085 | A | 2/1935 | McKay |
| 1,998,690 | A | 4/1935 | Shepherd et al. |
| 2,001,220 | A | 5/1935 | Smith |
| 2,001,918 | A | 5/1935 | Nevius |
| 2,016,030 | A | 10/1935 | Woodruff et al. |
| 2,043,343 | A | 6/1936 | Warner |
| 2,060,096 | A | 11/1936 | McCoy |
| 2,065,824 | A | 12/1936 | Plass |
| 2,159,958 | A | 5/1939 | Sachs |
| 2,185,474 | A | 1/1940 | Nott |
| 2,254,484 | A | 9/1941 | Hutchins |
| D132,360 | S | 5/1942 | Gardner |
| 2,328,153 | A | 8/1943 | Laing |
| 2,328,879 | A | 9/1943 | Isaacson |
| D139,530 | S | 11/1944 | Schindler |
| 2,364,413 | A | 12/1944 | Wittel |
| 2,525,305 | A | 10/1950 | Lombard |
| 2,543,522 | A | 2/1951 | Cohen |
| 2,588,582 | A | 3/1952 | Sivertson |
| 2,615,719 | A | 10/1952 | Fonken |
| 2,659,607 | A | 11/1953 | Skillman et al. |
| 2,661,215 | A | 12/1953 | Stevens |
| 2,676,020 | A | 4/1954 | Ogden |
| 2,692,777 | A | 10/1954 | Miller |
| 2,701,720 | A | 2/1955 | Ogden |
| 2,705,638 | A | 4/1955 | Newcomb |
| 2,711,319 | A | 6/1955 | Morgan et al. |
| 2,714,510 | A | 8/1955 | Oppenlander et al. |
| 2,717,782 | A | 9/1955 | Droll |
| 2,727,747 | A | 12/1955 | Semisch, Jr. |
| 2,731,271 | A | 1/1956 | Brown |
| 2,747,877 | A | 5/1956 | Howard |
| 2,755,090 | A | 7/1956 | Aldrich |
| 2,757,005 | A | 7/1956 | Nothaft |
| 2,760,779 | A | 8/1956 | Ogden et al. |
| 2,770,459 | A | 11/1956 | Wilson et al. |
| 2,778,643 | A | 1/1957 | Williams |
| 2,778,644 | A | 1/1957 | Stephenson |
| 2,782,040 | A | 2/1957 | Matter |
| 2,790,641 | A | 4/1957 | Adams |
| 2,793,863 | A | 5/1957 | Liebelt |
| 2,815,214 | A | 12/1957 | Hall |
| 2,821,399 | A | 1/1958 | Heinoo |
| 2,914,215 | A | 11/1959 | Neidig |
| 2,937,739 | A | 5/1960 | Levy |
| 2,950,005 | A | 8/1960 | MacDonald |
| RE24,986 | E | 5/1961 | Stephenson |
| 3,067,885 | A | 12/1962 | Kohler |
| 3,107,096 | A | 10/1963 | Osborn |
| 3,124,674 | A | 3/1964 | Edwards et al. |
| 3,131,935 | A | 5/1964 | Gronneberg |
| 3,147,978 | A | 9/1964 | Sjostrand |
| D200,652 | S | 3/1965 | Fisk |
| 3,185,482 | A | 5/1965 | Russell |
| 3,222,071 | A | 12/1965 | Lang |
| 3,235,741 | A | 2/1966 | Plaisance |
| 3,288,308 | A | 11/1966 | Gingher |
| 3,305,237 | A | 2/1967 | Granius |
| 3,312,473 | A | 4/1967 | Friedman et al. |
| 3,452,509 | A | 7/1969 | Hauer |
| 3,530,968 | A | 9/1970 | Palmer |
| 3,588,116 | A | 6/1971 | Miura |
| 3,589,730 | A | 6/1971 | Slay |
| 3,595,388 | A | 7/1971 | Castaldi |
| 3,597,076 | A | 8/1971 | Hubbard et al. |
| 3,598,396 | A | 8/1971 | Andrews et al. |
| 3,618,933 | A | 11/1971 | Roggenstein et al. |
| 3,627,331 | A | 12/1971 | Lyon, Jr. |
| 3,666,270 | A | 5/1972 | Mazur |
| 3,680,853 | A | 8/1972 | Houghton et al. |
| 3,690,670 | A | 9/1972 | Cassady et al. |
| 3,704,938 | A | 12/1972 | Fanselow |
| 3,716,238 | A | 2/1973 | Porter |
| 3,751,041 | A | 8/1973 | Seifert |
| 3,761,079 | A | 9/1973 | Azure, Jr. |
| 3,810,627 | A | 5/1974 | Levy |
| D232,953 | S | 9/1974 | Oguchi |
| 3,861,261 | A | 1/1975 | Maxey |
| 3,897,954 | A | 8/1975 | Erickson et al. |
| 3,899,178 | A | 8/1975 | Watanabe |
| 3,909,002 | A | 9/1975 | Levy |
| 3,929,339 | A | 12/1975 | Mattioli |
| 3,944,077 | A | 3/1976 | Green |
| 3,944,230 | A | 3/1976 | Fineman |
| 3,949,219 | A | 4/1976 | Crouse |
| 3,968,364 | A | 7/1976 | Miller |
| 4,023,705 | A | 5/1977 | Reiner et al. |
| 4,033,590 | A | 7/1977 | Pic |
| 4,072,930 | A | 2/1978 | Lucero et al. |
| 4,088,265 | A | 5/1978 | Garczynski |
| 4,151,410 | A | 4/1979 | McMillan et al. |
| 4,159,581 | A | 7/1979 | Lichtenberg |
| 4,162,649 | A | 7/1979 | Thornton |
| 4,166,615 | A | 9/1979 | Noguchi et al. |
| 4,232,861 | A | 11/1980 | Maul |
| 4,280,690 | A | 7/1981 | Hill |
| 4,283,709 | A | 8/1981 | Lucero et al. |
| 4,310,160 | A | 1/1982 | Willette et al. |
| 4,339,134 | A | 7/1982 | Macheel |
| 4,339,798 | A | 7/1982 | Hedges et al. |
| 4,361,393 | A | 11/1982 | Noto |
| 4,368,972 | A | 1/1983 | Naramore |
| 4,369,972 | A | 1/1983 | Parker |
| 4,374,309 | A | 2/1983 | Walton |
| 4,377,285 | A | 3/1983 | Kadlic |
| 4,385,827 | A | 5/1983 | Naramore |
| 4,388,994 | A | 6/1983 | Suda et al. |
| 4,397,469 | A | 8/1983 | Carter, III |
| 4,421,312 | A | 12/1983 | Delgado et al. |
| 4,421,501 | A | 12/1983 | Scheffer |
| D273,962 | S | 5/1984 | Fromm |
| D274,069 | S | 5/1984 | Fromm |
| 4,457,512 | A | 7/1984 | Stevenson |
| 4,467,424 | A | 8/1984 | Tedges et al. |
| 4,494,197 | A | 1/1985 | Troy et al. |
| 4,497,488 | A | 2/1985 | Plevyak et al. |
| 4,512,580 | A | 4/1985 | Matviak |
| 4,513,969 | A | 4/1985 | Samsel, Jr. |
| 4,515,367 | A | 5/1985 | Howard |
| 4,531,187 | A | 7/1985 | Uhland |
| 4,534,562 | A | 8/1985 | Cuff et al. |
| 4,549,738 | A | 10/1985 | Greitzer |
| 4,566,782 | A | 1/1986 | Britt et al. |
| 4,575,367 | A | 3/1986 | Karmel |
| 4,586,712 | A | 5/1986 | Lorber et al. |
| 4,659,082 | A | 4/1987 | Greenberg |
| 4,662,637 | A | 5/1987 | Pfeiffer |
| 4,662,816 | A | 5/1987 | Fabrig |
| 4,667,959 | A | 5/1987 | Pfeiffer et al. |
| 4,741,524 | A | 5/1988 | Bromage |
| 4,750,743 | A | 6/1988 | Nicoletti |
| 4,755,941 | A | 7/1988 | Bacchi |
| 4,759,448 | A | 7/1988 | Kawabata |
| 4,770,412 | A | 9/1988 | Wolfe |
| 4,770,421 | A | 9/1988 | Hoffman |
| 4,807,884 | A | 2/1989 | Breeding |
| 4,822,050 | A | 4/1989 | Normand et al. |
| 4,832,342 | A | 5/1989 | Plevyak et al. |
| 4,858,000 | A | 8/1989 | Lu |

(56) References Cited

U.S. PATENT DOCUMENTS 4,861,041 A 8/1989 Jones et al.
4,876,000 A 10/1989 Mikhail
4,900,009 A 2/1990 Kitahara et al.
4,904,830 A 2/1990 Rizzuto
4,921,109 A 5/1990 Hasuo et al.
4,926,327 A 5/1990 Sidley
4,948,134 A 8/1990 Suttle et al.
4,951,950 A 8/1990 Normand et al.
4,969,648 A 11/1990 Hollinger et al.
4,993,587 A 2/1991 Abe
4,995,615 A 2/1991 Cheng
5,000,453 A 3/1991 Stevens et al.
5,004,218 A 4/1991 Sardano et al.
5,039,102 A 8/1991 Miller
5,067,713 A 11/1991 Soules et al.
5,078,405 A 1/1992 Jones et al.
5,081,487 A 1/1992 Hoyer et al.
5,096,197 A 3/1992 Embury
5,102,293 A 4/1992 Schneider
5,118,114 A 6/1992 Tucci
5,121,192 A 6/1992 Kazui
5,121,921 A 6/1992 Friedman et al.
5,146,346 A 9/1992 Knoll
5,154,429 A 10/1992 LeVasseur
5,179,517 A 1/1993 Sarbin et al.
5,197,094 A 3/1993 Tillery et al.
5,199,710 A 4/1993 Lamle
5,209,476 A 5/1993 Eiba
5,224,712 A 7/1993 Laughlin et al.
5,240,140 A 8/1993 Huen
5,248,142 A 9/1993 Breeding
5,257,179 A 10/1993 DeMar
5,259,907 A 11/1993 Soules et al.
5,261,667 A 11/1993 Breeding
5,267,248 A 11/1993 Reyner
5,275,411 A 1/1994 Breeding
5,276,312 A 1/1994 McCarthy
5,283,422 A 2/1994 Storch et al.
5,288,081 A 2/1994 Breeding
5,299,089 A 3/1994 Lwee
5,303,921 A 4/1994 Breeding
5,344,146 A 9/1994 Lee
5,356,145 A 10/1994 Verschoor
5,362,053 A 11/1994 Miller
5,374,061 A 12/1994 Albrecht
5,377,973 A 1/1995 Jones et al.
5,382,024 A 1/1995 Blaha
5,382,025 A 1/1995 Sklansky et al.
5,390,910 A 2/1995 Mandel et al.
5,397,128 A 3/1995 Hesse et al.
5,397,133 A 3/1995 Penzias
5,416,308 A 5/1995 Hood et al.
5,431,399 A 7/1995 Kelley
5,431,407 A 7/1995 Hofberg et al.
5,437,462 A 8/1995 Breeding
5,445,377 A 8/1995 Steinbach
5,470,079 A 11/1995 LeStrange et al.
D365,853 S 1/1996 Zadro
5,489,101 A 2/1996 Moody
5,515,477 A 5/1996 Sutherland
5,524,888 A 6/1996 Heidel
5,531,448 A 7/1996 Moody
5,544,892 A 8/1996 Breeding
5,575,475 A 11/1996 Steinbach
5,584,483 A 12/1996 Sines et al.
5,586,766 A 12/1996 Forte et al.
5,586,936 A 12/1996 Bennett et al.
5,605,334 A 2/1997 McCrea, Jr.
5,613,912 A 3/1997 Slater
5,632,483 A 5/1997 Garczynski et al.
5,636,843 A 6/1997 Roberts
5,651,548 A 7/1997 French et al.
5,655,961 A 8/1997 Acres et al.
5,655,966 A 8/1997 Werdin et al.
5,669,816 A 9/1997 Garczynski et al.
5,676,231 A 10/1997 Legras et al.
5,676,372 A 10/1997 Sines et al.
5,681,039 A 10/1997 Miller
5,683,085 A 11/1997 Johnson et al.
5,685,543 A 11/1997 Garner
5,690,324 A 11/1997 Otomo et al.
5,692,748 A 12/1997 Frisco et al.
5,695,189 A 12/1997 Breeding et al.
5,701,565 A 12/1997 Morgan
5,707,286 A 1/1998 Carlson
5,707,287 A 1/1998 McCrea, Jr.
5,711,525 A 1/1998 Breeding
5,718,427 A 2/1998 Cranford et al.
5,719,288 A 2/1998 Sens et al.
5,720,484 A 2/1998 Hsu
5,722,893 A 3/1998 Hill et al.
5,735,525 A 4/1998 McCrea, Jr.
5,735,724 A 4/1998 Udagawa
5,735,742 A 4/1998 French
5,743,798 A 4/1998 Adams et al.
5,768,382 A 6/1998 Schneier et al.
5,770,533 A 6/1998 Franchi
5,770,553 A 6/1998 Kroner et al.
5,772,505 A 6/1998 Garczynski et al.
5,779,546 A 7/1998 Meissner et al.
5,781,647 A 7/1998 Fishbine et al.
5,785,321 A 7/1998 van Putten et al.
5,788,574 A 8/1998 Ornstein et al.
5,791,988 A 8/1998 Nomi
5,802,560 A 9/1998 Joseph et al.
5,803,808 A 9/1998 Strisower
5,810,355 A 9/1998 Trilli
5,813,326 A 9/1998 Salomon
5,813,912 A 9/1998 Shultz
5,814,796 A 9/1998 Benson
5,836,775 A 11/1998 Hiyama et al.
5,839,730 A 11/1998 Pike
5,845,906 A 12/1998 Wirth
5,851,011 A 12/1998 Lott
5,867,586 A 2/1999 Liang
5,879,233 A 3/1999 Stupero
5,883,804 A 3/1999 Christensen
5,890,717 A 4/1999 Rosewarne et al.
5,892,210 A 4/1999 Levasseur
5,909,876 A 6/1999 Brown
5,911,626 A 6/1999 McCrea, Jr.
5,919,090 A 7/1999 Mothwurf
D412,723 S 8/1999 Hachuel et al.
5,936,222 A 8/1999 Korsunsky
5,941,769 A 8/1999 Order
5,944,310 A 8/1999 Johnson et al.
D414,527 S 9/1999 Tedham
5,957,776 A 9/1999 Hoehne
5,974,150 A 10/1999 Kaish et al.
5,989,122 A 11/1999 Roblejo
5,991,308 A 11/1999 Fuhrmann et al.
6,015,311 A 1/2000 Benjamin et al.
6,019,368 A 2/2000 Sines et al.
6,019,374 A 2/2000 Breeding
6,039,650 A 3/2000 Hill
6,050,569 A 4/2000 Taylor
6,053,695 A 4/2000 Longoria et al.
6,061,449 A 5/2000 Candelore et al.
6,068,258 A 5/2000 Breeding et al.
6,069,564 A 5/2000 Hatano et al.
6,071,190 A 6/2000 Weiss et al.
6,093,103 A 7/2000 McCrea, Jr.
6,113,101 A 9/2000 Wirth
6,117,012 A 9/2000 McCrea, Jr.
D432,588 S 10/2000 Tedham
6,126,166 A 10/2000 Lorson et al.
6,131,817 A 10/2000 Miller
6,139,014 A 10/2000 Breeding et al.
6,149,154 A 11/2000 Grauzer et al.
6,154,131 A 11/2000 Jones, II et al.
6,165,069 A 12/2000 Sines et al.
6,165,072 A 12/2000 Davis et al.
6,183,362 B1 2/2001 Boushy
6,186,895 B1 2/2001 Oliver

(56) References Cited

U.S. PATENT DOCUMENTS

| | | | |
|---|---|---|---|
| 6,196,416 | B1 | 3/2001 | Seagle |
| 6,200,218 | B1 | 3/2001 | Lindsay |
| 6,210,274 | B1 | 4/2001 | Carlson |
| 6,213,310 | B1 | 4/2001 | Wennersten et al. |
| 6,217,447 | B1 | 4/2001 | Lofink et al. |
| 6,234,900 | B1 | 5/2001 | Cumbers |
| 6,236,223 | B1 | 5/2001 | Brady et al. |
| 6,250,632 | B1 | 6/2001 | Albrecht |
| 6,254,002 | B1 | 7/2001 | Litman |
| 6,254,096 | B1 | 7/2001 | Grauzer et al. |
| 6,254,484 | B1 | 7/2001 | McCrea, Jr. |
| 6,257,981 | B1 | 7/2001 | Acres et al. |
| 6,267,248 | B1 | 7/2001 | Johnson et al. |
| 6,267,648 | B1 | 7/2001 | Katayama et al. |
| 6,267,671 | B1 | 7/2001 | Hogan |
| 6,270,404 | B2 | 8/2001 | Sines et al. |
| 6,272,223 | B1 | 8/2001 | Carlson |
| 6,293,546 | B1 | 9/2001 | Hessing et al. |
| 6,293,864 | B1 | 9/2001 | Romero |
| 6,299,167 | B1 | 10/2001 | Sines et al. |
| 6,299,534 | B1 | 10/2001 | Breeding et al. |
| 6,299,536 | B1 | 10/2001 | Hill |
| 6,308,886 | B1 | 10/2001 | Benson et al. |
| 6,313,871 | B1 | 11/2001 | Schubert |
| 6,325,373 | B1 | 12/2001 | Breeding et al. |
| 6,334,614 | B1 | 1/2002 | Breeding |
| 6,341,778 | B1 | 1/2002 | Lee |
| 6,342,830 | B1 | 1/2002 | Want et al. |
| 6,346,044 | B1 | 2/2002 | McCrea, Jr. |
| 6,361,044 | B1 | 3/2002 | Block |
| 6,386,973 | B1 | 5/2002 | Yoseloff |
| 6,402,142 | B1 | 6/2002 | Warren et al. |
| 6,403,908 | B2 | 6/2002 | Stardust et al. |
| 6,443,839 | B2 | 9/2002 | Stockdale et al. |
| 6,446,864 | B1 | 9/2002 | Kim et al. |
| 6,454,266 | B1 | 9/2002 | Breeding et al. |
| 6,460,848 | B1 | 10/2002 | Soltys et al. |
| 6,464,584 | B2 | 10/2002 | Oliver |
| 6,490,277 | B1 | 12/2002 | Tzotzkov |
| 6,508,709 | B1 | 1/2003 | Karmarkar |
| 6,514,140 | B1 | 2/2003 | Storch |
| 6,517,435 | B2 | 2/2003 | Soltys et al. |
| 6,517,436 | B2 | 2/2003 | Soltys et al. |
| 6,520,857 | B2 | 2/2003 | Soltys et al. |
| 6,527,271 | B2 | 3/2003 | Soltys et al. |
| 6,530,836 | B2 | 3/2003 | Soltys et al. |
| 6,530,837 | B2 | 3/2003 | Soltys et al. |
| 6,532,297 | B1 | 3/2003 | Lindquist |
| 6,533,276 | B2 | 3/2003 | Soltys et al. |
| 6,533,662 | B2 | 3/2003 | Soltys et al. |
| 6,543,770 | B1 | 4/2003 | Kaji et al. |
| 6,561,897 | B1 | 5/2003 | Bourbour et al. |
| 6,568,678 | B2 | 5/2003 | Breeding et al. |
| 6,579,180 | B2 | 6/2003 | Soltys et al. |
| 6,579,181 | B2 | 6/2003 | Soltys et al. |
| 6,581,747 | B1 | 6/2003 | Charlier et al. |
| 6,582,301 | B2 | 6/2003 | Hill |
| 6,582,302 | B2 | 6/2003 | Romero |
| 6,585,586 | B1 | 7/2003 | Romero |
| 6,585,588 | B2 | 7/2003 | Hard |
| 6,585,856 | B2 | 7/2003 | Zwick et al. |
| 6,588,750 | B1 | 7/2003 | Grauzer et al. |
| 6,588,751 | B1 | 7/2003 | Grauzer et al. |
| 6,595,857 | B2 | 7/2003 | Soltys et al. |
| 6,609,710 | B1 | 8/2003 | Order |
| 6,612,928 | B1 | 9/2003 | Bradford et al. |
| 6,616,535 | B1 | 9/2003 | Nishizaki et al. |
| 6,619,662 | B2 | 9/2003 | Miller |
| 6,622,185 | B1 | 9/2003 | Johnson et al. |
| 6,626,757 | B2 | 9/2003 | Oliveras |
| 6,629,019 | B2 | 9/2003 | Legge et al. |
| 6,629,591 | B1 | 10/2003 | Griswold et al. |
| 6,629,889 | B2 | 10/2003 | Mothwurf |
| 6,629,894 | B1 | 10/2003 | Purton |
| 6,637,622 | B1 | 10/2003 | Robinson |
| 6,638,161 | B2 | 10/2003 | Soltys et al. |
| 6,645,068 | B1 | 11/2003 | Kelly et al. |
| 6,645,077 | B2 | 11/2003 | Rowe |
| 6,651,981 | B2 | 11/2003 | Grauzer et al. |
| 6,651,982 | B2 | 11/2003 | Grauzer et al. |
| 6,651,985 | B2 | 11/2003 | Sines et al. |
| 6,652,379 | B2 | 11/2003 | Soltys et al. |
| 6,655,684 | B2 | 12/2003 | Grauzer et al. |
| 6,655,690 | B1 | 12/2003 | Oskwarek |
| 6,658,135 | B1 | 12/2003 | Morito et al. |
| 6,659,460 | B2 | 12/2003 | Blaha et al. |
| 6,659,461 | B2 | 12/2003 | Yoseloff |
| 6,659,875 | B2 | 12/2003 | Purton |
| 6,663,490 | B2 | 12/2003 | Soltys et al. |
| 6,666,768 | B1 | 12/2003 | Akers |
| 6,671,358 | B1 | 12/2003 | Seidman et al. |
| 6,676,127 | B2 | 1/2004 | Johnson et al. |
| 6,676,517 | B2 | 1/2004 | Beavers |
| 6,680,843 | B2 | 1/2004 | Farrow et al. |
| 6,685,564 | B2 | 2/2004 | Oliver |
| 6,685,567 | B2 | 2/2004 | Cockerille et al. |
| 6,685,568 | B2 | 2/2004 | Soltys et al. |
| 6,688,597 | B2 | 2/2004 | Jones |
| 6,688,979 | B2 | 2/2004 | Soltys et al. |
| 6,690,673 | B1 | 2/2004 | Jarvis |
| 6,698,756 | B1 | 3/2004 | Baker et al. |
| 6,698,759 | B2 | 3/2004 | Webb et al. |
| 6,702,289 | B1 | 3/2004 | Feola |
| 6,702,290 | B2 | 3/2004 | Buono-Correa et al. |
| 6,709,333 | B1 | 3/2004 | Bradford et al. |
| 6,712,696 | B2 | 3/2004 | Soltys et al. |
| 6,719,288 | B2 | 4/2004 | Hessing et al. |
| 6,719,634 | B2 | 4/2004 | Mishina et al. |
| 6,722,974 | B2 | 4/2004 | Sines et al. |
| 6,726,205 | B1 | 4/2004 | Purton |
| 6,732,067 | B1 | 5/2004 | Powderly |
| 6,733,012 | B2 | 5/2004 | Bui et al. |
| 6,733,388 | B2 | 5/2004 | Mothwurf |
| 6,746,333 | B1 | 6/2004 | Onda et al. |
| 6,747,560 | B2 | 6/2004 | Stevens, III |
| 6,749,510 | B2 | 6/2004 | Giobbi |
| 6,758,751 | B2 | 7/2004 | Soltys et al. |
| 6,758,757 | B2 | 7/2004 | Luciano, Jr. et al. |
| 6,769,693 | B2 | 8/2004 | Huard et al. |
| 6,774,782 | B2 | 8/2004 | Runyon et al. |
| 6,789,801 | B2 | 9/2004 | Snow |
| 6,802,510 | B1 | 10/2004 | Haber |
| 6,804,763 | B1 | 10/2004 | Stockdale et al. |
| 6,808,173 | B2 | 10/2004 | Snow |
| 6,827,282 | B2 | 12/2004 | Silverbrook |
| 6,834,251 | B1 | 12/2004 | Fletcher |
| 6,840,517 | B2 | 1/2005 | Snow et al. |
| 6,842,263 | B1 | 1/2005 | Saeki |
| 6,843,725 | B2 | 1/2005 | Nelson |
| 6,848,616 | B2 | 2/2005 | Tsirline et al. |
| 6,848,844 | B2 | 2/2005 | McCue, Jr. et al. |
| 6,848,994 | B1 | 2/2005 | Knust et al. |
| 6,857,961 | B2 | 2/2005 | Soltys et al. |
| 6,874,784 | B1 | 4/2005 | Promutico et al. |
| 6,874,786 | B2 | 4/2005 | Bruno |
| 6,877,657 | B2 | 4/2005 | Ranard et al. |
| 6,877,748 | B1 | 4/2005 | Patroni et al. |
| 6,886,829 | B2 | 5/2005 | Hessing et al. |
| 6,889,979 | B2 | 5/2005 | Blaha et al. |
| 6,893,347 | B1 | 5/2005 | Zilliacus et al. |
| 6,899,628 | B2 | 5/2005 | Leen et al. |
| 6,902,167 | B2 | 6/2005 | Webb |
| 6,905,121 | B1 | 6/2005 | Timpano |
| 6,923,446 | B2 | 8/2005 | Snow |
| 6,938,900 | B2 | 9/2005 | Snow |
| 6,941,180 | B1 | 9/2005 | Fisher et al. |
| 6,950,948 | B2 | 9/2005 | Neff |
| 6,955,599 | B2 | 10/2005 | Bourbour et al. |
| 6,957,746 | B2 | 10/2005 | Martin et al. |
| 6,959,925 | B1 | 11/2005 | Baker et al. |
| 6,960,134 | B2 | 11/2005 | Hartl et al. |
| 6,964,612 | B2 | 11/2005 | Soltys et al. |
| 6,986,514 | B2 | 1/2006 | Snow |
| 6,988,516 | B2 | 1/2006 | Debaes |

(56) References Cited

U.S. PATENT DOCUMENTS 7,011,309 B2 3/2006 Soltys et al.
7,020,307 B2 3/2006 Hinton et al.
7,028,598 B2 4/2006 Teshima
7,029,009 B2 4/2006 Grauzer et al.
7,036,818 B2 5/2006 Grauzer et al.
7,046,458 B2 5/2006 Nakayama
7,046,764 B1 5/2006 Kump
7,048,629 B2 5/2006 Sines et al.
7,059,602 B2 6/2006 Grauzer et al.
7,066,464 B2 6/2006 Blad et al.
7,068,822 B2 6/2006 Scott
7,073,791 B2 7/2006 Grauzer et al.
7,079,010 B2 7/2006 Champlin
7,084,769 B2 8/2006 Bauer et al.
7,089,420 B1 8/2006 Durst et al.
D527,900 S 9/2006 Dewa
7,106,201 B2 9/2006 Tuttle
7,113,094 B2 9/2006 Garber et al.
7,114,718 B2 10/2006 Grauzer et al.
7,124,947 B2 10/2006 Storch
7,128,652 B1 10/2006 Lavoie et al.
7,137,627 B2 11/2006 Grauzer et al.
7,139,108 B2 11/2006 Andersen et al.
7,140,614 B2 11/2006 Snow
7,162,035 B1 1/2007 Durst et al.
7,165,769 B2 1/2007 Crenshaw et al.
7,165,770 B2 1/2007 Snow
7,175,522 B2 2/2007 Hartl
7,186,181 B2 3/2007 Rowe
7,201,656 B2 4/2007 Darder
7,202,888 B2 4/2007 Tecu et al.
7,203,841 B2 4/2007 Jackson et al.
7,213,812 B2 5/2007 Schubert
7,222,852 B2 5/2007 Soltys
7,222,855 B2 5/2007 Sorge
7,231,812 B1 6/2007 Lagare
7,234,698 B2 6/2007 Grauzer et al.
7,237,969 B2 7/2007 Bartman
7,243,148 B2 7/2007 Keir et al.
7,243,698 B2 7/2007 Siegel
7,246,799 B2 7/2007 Snow
7,255,344 B2 8/2007 Grauzer et al.
7,255,351 B2 8/2007 Yoseloff et al.
7,255,642 B2 8/2007 Sines et al.
7,257,630 B2 8/2007 Cole et al.
7,261,294 B2 8/2007 Grauzer et al.
7,264,241 B2 9/2007 Schubert et al.
7,264,243 B2 9/2007 Yoseloff et al.
7,277,570 B2 10/2007 Armstrong
7,278,923 B2 10/2007 Grauzer et al.
7,294,056 B2 11/2007 Lowell et al.
7,297,062 B2 11/2007 Gatto et al.
7,300,056 B2 11/2007 Gioia et al.
7,303,473 B2 12/2007 Rowe
7,303,475 B2 12/2007 Britt et al.
7,309,065 B2 12/2007 Yoseloff et al.
7,316,609 B2 1/2008 Dunn et al.
7,316,615 B2 1/2008 Soltys et al.
7,322,576 B2 1/2008 Grauzer et al.
7,331,579 B2 2/2008 Snow
7,334,794 B2 2/2008 Snow
7,338,044 B2 3/2008 Grauzer et al.
7,338,362 B1 3/2008 Gallagher
7,341,510 B2 3/2008 Bourbour et al.
D566,784 S 4/2008 Palmer
7,357,321 B2 4/2008 Yoshida
7,360,094 B2 4/2008 Neff
7,367,561 B2 5/2008 Blaha et al.
7,367,563 B2 5/2008 Yoseloff et al.
7,367,565 B2 5/2008 Chiu
7,367,884 B2 5/2008 Breeding et al.
7,374,170 B2 5/2008 Grauzer et al.
7,384,044 B2 6/2008 Grauzer et al.
7,387,300 B2 6/2008 Snow
7,389,990 B2 6/2008 Mourad
7,390,256 B2 6/2008 Soltys et al.
7,399,226 B2 7/2008 Mishra
7,407,438 B2 8/2008 Schubert et al.
7,413,191 B2 8/2008 Grauzer et al.
7,434,805 B2 10/2008 Grauzer et al.
7,436,957 B1 10/2008 Fisher et al.
7,448,626 B2 11/2008 Fleckenstein
7,458,582 B2 12/2008 Snow et al.
7,461,843 B1 12/2008 Baker et al.
7,464,932 B2 12/2008 Darling
7,464,934 B2 12/2008 Schwartz
7,472,906 B2 1/2009 Shai
7,478,813 B1 1/2009 Hofferber et al.
7,500,672 B2 3/2009 Ho
7,506,874 B2 3/2009 Hall
7,510,186 B2 3/2009 Fleckenstein
7,510,190 B2 3/2009 Snow et al.
7,510,194 B2 3/2009 Soltys et al.
7,510,478 B2 3/2009 Benbrahim et al.
7,513,437 B2 4/2009 Douglas
7,515,718 B2 4/2009 Nguyen et al.
7,523,935 B2 4/2009 Grauzer et al.
7,523,936 B2 4/2009 Grauzer et al.
7,523,937 B2 4/2009 Fleckenstein
7,525,510 B2 4/2009 Beland et al.
7,537,216 B2 5/2009 Soltys et al.
7,540,497 B2 6/2009 Tseng
7,540,498 B2 6/2009 Crenshaw et al.
7,549,643 B2 6/2009 Quach
7,554,753 B2 6/2009 Wakamiya
7,556,197 B2 7/2009 Yoshida
7,556,266 B2 7/2009 Blaha et al.
7,575,237 B2 8/2009 Snow
7,578,506 B2 8/2009 Ambert
7,584,962 B2 9/2009 Breeding et al.
7,584,963 B2 9/2009 Krenn et al.
7,584,966 B2 9/2009 Snow
7,591,728 B2 9/2009 Gioia et al.
7,593,544 B2 9/2009 Downs
7,594,660 B2 9/2009 Baker et al.
7,597,623 B2 10/2009 Grauzer et al.
7,644,923 B1 1/2010 Dickinson et al.
7,661,676 B2 2/2010 Smith et al.
7,666,090 B2 2/2010 Hettinger
7,669,852 B2 3/2010 Baker et al.
7,669,853 B2 3/2010 Jones
7,677,565 B2 3/2010 Grauzer et al.
7,677,566 B2 3/2010 Krenn et al.
7,686,681 B2 3/2010 Soltys et al.
7,699,694 B2 4/2010 Hill
7,735,657 B2 6/2010 Johnson
7,740,244 B2 6/2010 Ho
7,744,452 B2 6/2010 Cimring et al.
7,753,373 B2 7/2010 Grauzer et al.
7,753,374 B2 7/2010 Ho
7,753,798 B2 7/2010 Soltys
7,758,425 B2 7/2010 Poh et al.
7,762,554 B2 7/2010 Ho
7,764,836 B2 7/2010 Downs, III et al.
7,766,332 B2 8/2010 Grauzer et al.
7,766,333 B1 8/2010 Stardust
7,769,232 B2 8/2010 Downs, III
7,769,853 B2 8/2010 Nezamzadeh
7,773,749 B1 8/2010 Durst et al.
7,780,529 B2 8/2010 Rowe et al.
7,784,790 B2 8/2010 Grauzer et al.
7,804,982 B2 9/2010 Howard et al.
7,824,255 B2 11/2010 Lutnick
7,846,020 B2 12/2010 Walker et al.
7,854,430 B2 12/2010 Toyama
7,867,080 B2 1/2011 Nicely et al.
7,874,559 B1 * 1/2011 Tseng ..... A63F 1/12 273/149 R
7,890,365 B2 2/2011 Hettinger
7,900,923 B2 3/2011 Toyama et al.
7,901,285 B2 3/2011 Tran et al.
7,908,169 B2 3/2011 Hettinger
7,909,689 B2 3/2011 Lardie
7,931,533 B2 4/2011 LeMay et al.

(56) References Cited

U.S. PATENT DOCUMENTS 7,933,448 B2 4/2011 Downs, III
7,946,586 B2 5/2011 Krenn et al.
7,967,294 B2 6/2011 Blaha et al.
7,976,023 B1 7/2011 Hessing et al.
7,988,152 B2 8/2011 Sines et al.
7,988,554 B2 8/2011 LeMay et al.
7,995,196 B1 8/2011 Fraser
8,002,638 B2 8/2011 Grauzer et al.
8,011,661 B2 9/2011 Stasson
8,016,663 B2 9/2011 Soltys et al.
8,021,231 B2 9/2011 Walker et al.
8,025,294 B2 9/2011 Grauzer et al.
8,038,521 B2 10/2011 Grauzer et al.
RE42,944 E 11/2011 Blaha et al.
8,057,302 B2 11/2011 Wells et al.
8,062,134 B2 11/2011 Kelly et al.
8,070,574 B2 12/2011 Grauzer et al.
8,092,307 B2 1/2012 Kelly
8,092,309 B2 1/2012 Bickley
8,109,514 B2 2/2012 Toyama
8,141,875 B2 3/2012 Grauzer et al.
8,150,158 B2 4/2012 Downs, III
8,171,567 B1 5/2012 Fraser et al.
8,210,536 B2 7/2012 Blaha et al.
8,221,244 B2 7/2012 French
8,251,293 B2 8/2012 Nagata et al.
8,267,404 B2 9/2012 Grauzer et al.
8,270,603 B1 9/2012 Durst et al.
8,287,347 B2 10/2012 Snow et al.
8,287,386 B2 10/2012 Miller et al.
8,319,666 B2 11/2012 Weinmann et al.
8,337,296 B2 12/2012 Grauzer et al.
8,342,525 B2 1/2013 Scheper et al.
8,342,526 B1 1/2013 Sampson
8,342,529 B2 1/2013 Snow
8,353,513 B2 1/2013 Swanson
8,381,918 B2 2/2013 Johnson
8,408,550 B2 4/2013 Walker
8,419,521 B2 4/2013 Grauzer et al.
8,429,229 B2 4/2013 Sepich et al.
8,444,147 B2 5/2013 Grauzer et al.
8,444,489 B2 5/2013 Lian et al.
8,469,360 B2 6/2013 Sines
8,475,252 B2 7/2013 Savage et al.
8,480,088 B2 7/2013 Toyama et al.
8,485,527 B2 7/2013 Sampson et al.
8,490,973 B2 7/2013 Yoseloff et al.
8,498,444 B2 7/2013 Sharma
8,505,916 B2 8/2013 Grauzer et al.
8,511,684 B2 8/2013 Grauzer et al.
8,512,146 B2 8/2013 Gururajan et al.
8,550,464 B2 10/2013 Soltys et al.
8,556,263 B2 10/2013 Grauzer et al.
8,579,289 B2 11/2013 Rynda et al.
RE44,616 E 12/2013 Blaha et al.
8,602,416 B2 12/2013 Toyama
8,616,552 B2 12/2013 Czyzewski et al.
8,628,086 B2 1/2014 Krenn et al.
8,651,485 B2 2/2014 Stasson
8,662,500 B2 3/2014 Swanson
8,695,978 B1 4/2014 Ho
8,702,100 B2 4/2014 Snow et al.
8,702,101 B2 4/2014 Scheper et al.
8,720,891 B2 5/2014 Hessing et al.
8,758,111 B2 6/2014 Lutnick
8,777,710 B2 7/2014 Grauzer et al.
8,800,993 B2 8/2014 Blaha et al.
8,820,745 B2 9/2014 Grauzer et al.
8,844,930 B2 9/2014 Sampson et al.
8,899,587 B2 12/2014 Grauzer et al.
8,919,775 B2 12/2014 Wadds et al.
9,101,821 B2 8/2015 Snow
9,251,661 B2 2/2016 Tammesoo
9,266,012 B2 2/2016 Grauzer
9,280,866 B2 3/2016 Nayak et al.
9,378,766 B2 6/2016 Kelly et al.
9,474,957 B2 10/2016 Haushalter et al.
9,504,905 B2 11/2016 Kelly et al.
9,511,274 B2 12/2016 Kelly et al.
9,566,501 B2 2/2017 Stasson et al.
9,679,603 B2 6/2017 Kelly et al.
9,731,190 B2 8/2017 Sampson et al.
10,857,448 B2 12/2020 Kelly et al.
11,173,383 B2 11/2021 Krenn et al.
2001/0035604 A1 11/2001 Jones
2001/0036231 A1 11/2001 Easwar et al.
2001/0036866 A1 11/2001 Stockdale et al.
2001/0054576 A1 12/2001 Stardust et al.
2002/0017481 A1 2/2002 Johnson et al.
2002/0045478 A1 4/2002 Soltys et al.
2002/0045481 A1 4/2002 Soltys et al.
2002/0063389 A1 5/2002 Breeding et al.
2002/0068635 A1 6/2002 Hill
2002/0070499 A1 6/2002 Breeding et al.
2002/0094869 A1 7/2002 Harkham
2002/0107067 A1 8/2002 McGlone et al.
2002/0107072 A1 8/2002 Giobbi
2002/0113368 A1 8/2002 Hessing et al.
2002/0135692 A1 9/2002 Fujinawa
2002/0142820 A1 10/2002 Bartlett
2002/0155869 A1 10/2002 Soltys et al.
2002/0163122 A1 11/2002 Vancura
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0042673 A1 3/2003 Grauzer
2003/0047870 A1 3/2003 Blaha et al.
2003/0048476 A1 3/2003 Yamakawa
2003/0052449 A1 3/2003 Grauzer et al.
2003/0052450 A1 3/2003 Grauzer et al.
2003/0064798 A1 4/2003 Grauzer et al.
2003/0067112 A1 4/2003 Grauzer et al.
2003/0071413 A1 4/2003 Blaha et al.
2003/0073498 A1 4/2003 Grauzer et al.
2003/0075865 A1 4/2003 Grauzer et al.
2003/0075866 A1 4/2003 Blaha et al.
2003/0087694 A1 5/2003 Storch
2003/0090059 A1 5/2003 Grauzer et al.
2003/0094756 A1 5/2003 Grauzer et al.
2003/0151194 A1 8/2003 Hessing et al.
2003/0195025 A1 10/2003 Hill
2004/0015423 A1 1/2004 Walker et al.
2004/0036214 A1 2/2004 Baker et al.
2004/0067789 A1 4/2004 Grauzer et al.
2004/0100026 A1 5/2004 Haggard
2004/0108255 A1 6/2004 Johnson
2004/0108654 A1 6/2004 Grauzer et al.
2004/0116179 A1 6/2004 Nicely et al.
2004/0169332 A1 9/2004 Grauzer et al.
2004/0180722 A1 9/2004 Giobbi
2004/0224777 A1 11/2004 Smith et al.
2004/0245720 A1 12/2004 Grauzer et al.
2004/0259618 A1 12/2004 Soltys et al.
2005/0012671 A1 1/2005 Bisig
2005/0012818 A1 1/2005 Kiely et al.
2005/0023752 A1 2/2005 Grauzer et al.
2005/0026680 A1 2/2005 Gururajan
2005/0035548 A1 2/2005 Yoseloff
2005/0037843 A1 2/2005 Wells et al.
2005/0040594 A1* 2/2005 Krenn ..... A63F 1/12
273/149 R
2005/0051955 A1 3/2005 Schubert et al.
2005/0051956 A1 3/2005 Grauzer et al.
2005/0062227 A1 3/2005 Grauzer et al.
2005/0062228 A1 3/2005 Grauzer et al.
2005/0062229 A1 3/2005 Grauzer et al.
2005/0082750 A1 4/2005 Grauzer et al.
2005/0093231 A1 5/2005 Grauzer et al.
2005/0104289 A1 5/2005 Grauzer et al.
2005/0104290 A1 5/2005 Grauzer et al.
2005/0110210 A1 5/2005 Soltys et al.
2005/0113166 A1 5/2005 Grauzer et al.

(56) References Cited

U.S. PATENT DOCUMENTS

2005/0113171 A1 5/2005 Hodgson
2005/0119048 A1 6/2005 Soltys
2005/0121852 A1 6/2005 Soltys et al.
2005/0137005 A1 6/2005 Soltys et al.
2005/0140090 A1 6/2005 Breeding et al.
2005/0146093 A1 7/2005 Grauzer et al.
2005/0148391 A1 7/2005 Tain
2005/0164759 A1 7/2005 Smith et al.
2005/0164761 A1 7/2005 Tain
2005/0192092 A1 9/2005 Breckner et al.
2005/0206077 A1 9/2005 Grauzer et al.
2005/0242500 A1 11/2005 Downs
2005/0272501 A1 12/2005 Tran et al.
2005/0277463 A1 12/2005 Knust
2005/0288083 A1 12/2005 Downs
2005/0288086 A1 12/2005 Schubert et al.
2006/0027970 A1 2/2006 Kyrychenko
2006/0033269 A1 2/2006 Grauzer et al.
2006/0033270 A1 2/2006 Grauzer et al.
2006/0046853 A1 3/2006 Black
2006/0055114 A1 3/2006 White et al.
2006/0063577 A1 3/2006 Downs, III et al.
2006/0066048 A1 3/2006 Krenn et al.
2006/0084502 A1 4/2006 Downs et al.
2006/0151946 A1 7/2006 Ngai
2006/0181022 A1 8/2006 Grauzer et al.
2006/0183540 A1 8/2006 Grauzer et al.
2006/0189381 A1 8/2006 Daniel et al.
2006/0199649 A1 9/2006 Soltys et al.
2006/0205508 A1 9/2006 Green
2006/0220312 A1 10/2006 Baker et al.
2006/0220313 A1 10/2006 Baker et al.
2006/0252521 A1 11/2006 Gururajan et al.
2006/0252554 A1 11/2006 Gururajan et al.
2006/0279040 A1 12/2006 Downs et al.
2006/0281534 A1 12/2006 Grauzer et al.
2007/0001395 A1 1/2007 Gioia et al.
2007/0006708 A1 1/2007 Laakso
2007/0015583 A1 1/2007 Tran
2007/0018389 A1 1/2007 Downs, III
2007/0045959 A1 3/2007 Soltys
2007/0049368 A1 3/2007 Kuhn et al.
2007/0057454 A1 3/2007 Fleckenstein
2007/0057469 A1 3/2007 Grauzer et al.
2007/0066387 A1 3/2007 Matsuno et al.
2007/0069462 A1 3/2007 Downs, III et al.
2007/0072677 A1 3/2007 Lavoie et al.
2007/0102879 A1 5/2007 Stasson
2007/0111773 A1 5/2007 Gururajan et al.
2007/0184905 A1 8/2007 Gatto et al.
2007/0197294 A1 8/2007 Gong
2007/0197298 A1 8/2007 Rowe
2007/0202941 A1 8/2007 Miltenberger et al.
2007/0222147 A1 9/2007 Blaha et al.
2007/0225055 A1 9/2007 Weisman
2007/0233567 A1 10/2007 Daly
2007/0238506 A1 10/2007 Ruckle
2007/0241498 A1* 10/2007 Soltys ..... A63F 1/16 273/149 R
2007/0259709 A1 11/2007 Kelly et al.
2007/0267812 A1 11/2007 Grauzer et al.
2007/0272600 A1 11/2007 Johnson
2007/0278739 A1 12/2007 Swanson
2007/0287534 A1 12/2007 Fleckenstein
2007/0290438 A1 12/2007 Grauzer et al.
2007/0298865 A1 12/2007 Soltys
2008/0004107 A1 1/2008 Nguyen et al.
2008/0006997 A1 1/2008 Scheper et al.
2008/0006998 A1 1/2008 Grauzer et al.
2008/0022415 A1 1/2008 Kuo et al.
2008/0032763 A1 2/2008 Giobbi
2008/0039192 A1 2/2008 Laut
2008/0039208 A1 2/2008 Abrink et al.
2008/0096656 A1 4/2008 LeMay et al.
2008/0111300 A1 5/2008 Czyzewski et al.
2008/0113700 A1 5/2008 Czyzewski et al.
2008/0113783 A1 5/2008 Czyzewski et al.
2008/0136108 A1 6/2008 Polay
2008/0143048 A1 6/2008 Shigeta
2008/0176627 A1 7/2008 Lardie
2008/0217218 A1 9/2008 Johnson
2008/0234046 A1 9/2008 Kinsley
2008/0234047 A1 9/2008 Nguyen
2008/0248875 A1 10/2008 Beatty
2008/0284096 A1 11/2008 Toyama et al.
2008/0303210 A1* 12/2008 Grauzer ..... G07F 17/3225 273/149 R
2008/0315517 A1 12/2008 Toyama et al.
2009/0026700 A2 1/2009 Shigeta
2009/0048026 A1 2/2009 French
2009/0054161 A1 2/2009 Schuber et al.
2009/0072477 A1 3/2009 Tseng et al.
2009/0121429 A1 3/2009 Walsh et al.
2009/0091078 A1 4/2009 Grauzer et al.
2009/0100409 A1 4/2009 Toneguzzo
2009/0104963 A1 4/2009 Burman
2009/0134575 A1* 5/2009 Dickinson ..... A63F 1/062 273/149 R
2009/0140492 A1 6/2009 Yoseloff et al.
2009/0166970 A1 7/2009 Rosh et al.
2009/0176547 A1 7/2009 Katz
2009/0179378 A1 7/2009 Amaitis et al.
2009/0186676 A1 7/2009 Amaitis et al.
2009/0189346 A1 7/2009 Krenn et al.
2009/0191933 A1 7/2009 French
2009/0194988 A1 8/2009 Wright et al.
2009/0197662 A1 8/2009 Wright et al.
2009/0224476 A1 9/2009 Grauzer et al.
2009/0227318 A1 9/2009 Wright et al.
2009/0227360 A1 9/2009 Gioia et al.
2009/0243213 A1* 10/2009 Pececnik ..... A63F 1/12 273/149 R
2009/0250873 A1 10/2009 Jones
2009/0253478 A1 10/2009 Walker et al.
2009/0253503 A1 10/2009 Krise et al.
2009/0267296 A1 10/2009 Ho et al.
2009/0267297 A1 10/2009 Blaha et al.
2009/0283969 A1 11/2009 Tseng et al.
2009/0298577 A1 12/2009 Gagner et al.
2009/0302535 A1 12/2009 Ho et al.
2009/0302537 A1 12/2009 Ho et al.
2009/0312093 A1 12/2009 Walker et al.
2009/0314188 A1 12/2009 Toyama et al.
2010/0013152 A1 1/2010 Grauzer
2010/0038849 A1 2/2010 Scheper et al.
2010/0048304 A1 2/2010 Boesen
2010/0069155 A1 3/2010 Schwartz et al.
2010/0178987 A1 7/2010 Pacey
2010/0197410 A1 8/2010 Leen et al.
2010/0234110 A1 9/2010 Clarkson
2010/0240440 A1 9/2010 Szrek et al.
2010/0244376 A1 9/2010 Johnson
2010/0244382 A1 9/2010 Snow
2010/0252992 A1 10/2010 Sines
2010/0255899 A1 10/2010 Paulsen
2010/0276880 A1 11/2010 Grauzer et al.
2010/0311493 A1 12/2010 Miller et al.
2010/0311494 A1 12/2010 Miller et al.
2010/0314830 A1 12/2010 Grauzer et al.
2010/0320685 A1 12/2010 Grauzer
2011/0006480 A1 1/2011 Grauzer
2011/0012303 A1 1/2011 Kourgiantakis et al.
2011/0024981 A1 2/2011 Tseng
2011/0052049 A1 3/2011 Rajaraman et al.
2011/0062662 A1 3/2011 Ohta
2011/0078096 A1 3/2011 Bounds
2011/0079959 A1 4/2011 Hartley
2011/0105208 A1 5/2011 Bickley
2011/0109042 A1 5/2011 Rynda
2011/0130185 A1 6/2011 Walker
2011/0130190 A1 6/2011 Hamman et al.
2011/0159952 A1 6/2011 Kerr
2011/0159953 A1 6/2011 Kerr
2011/0165936 A1 7/2011 Kerr

(56) References Cited

U.S. PATENT DOCUMENTS

| | | | |
|---|---|---|---|
| 2011/0172008 | A1 | 7/2011 | Alderucci |
| 2011/0183748 | A1 | 7/2011 | Wilson et al. |
| 2011/0230148 | A1 | 9/2011 | Demuynck et al. |
| 2011/0230268 | A1 | 9/2011 | Williams |
| 2011/0233863 | A1 | 9/2011 | Toyama |
| 2011/0269529 | A1 | 11/2011 | Baerlocher |
| 2011/0272881 | A1 | 11/2011 | Sines |
| 2011/0285081 | A1 | 11/2011 | Stasson |
| 2011/0287829 | A1 | 11/2011 | Clarkson et al. |
| 2012/0015724 | A1 | 1/2012 | Ocko et al. |
| 2012/0015725 | A1 | 1/2012 | Ocko et al. |
| 2012/0015743 | A1 | 1/2012 | Lam et al. |
| 2012/0015747 | A1 | 1/2012 | Ocko et al. |
| 2012/0021835 | A1 | 1/2012 | Keller et al. |
| 2012/0034977 | A1 | 2/2012 | Kammler |
| 2012/0062745 | A1 | 3/2012 | Han et al. |
| 2012/0074646 | A1 | 3/2012 | Grauzer et al. |
| 2012/0091656 | A1* | 4/2012 | Blaha ..... A63F 1/12 273/149 R |
| 2012/0095982 | A1 | 4/2012 | Lennington et al. |
| 2012/0161393 | A1 | 6/2012 | Krenn et al. |
| 2012/0175841 | A1 | 7/2012 | Grauzer |
| 2012/0181747 | A1 | 7/2012 | Grauzer et al. |
| 2012/0187625 | A1 | 7/2012 | Downs, III et al. |
| 2012/0242782 | A1 | 9/2012 | Huang |
| 2012/0286471 | A1 | 11/2012 | Grauzer et al. |
| 2012/0306152 | A1 | 12/2012 | Krishnamurty et al. |
| 2013/0020761 | A1 | 1/2013 | Sines et al. |
| 2013/0023318 | A1 | 1/2013 | Abrahamson |
| 2013/0026709 | A1 | 1/2013 | Sampson et al. |
| 2013/0085638 | A1 | 4/2013 | Weinmann et al. |
| 2013/0099448 | A1 | 4/2013 | Scheper et al. |
| 2013/0109455 | A1 | 5/2013 | Grauzer et al. |
| 2013/0132306 | A1 | 5/2013 | Kami et al. |
| 2013/0147116 | A1 | 6/2013 | Stasson |
| 2013/0161905 | A1 | 6/2013 | Grauzer et al. |
| 2013/0228972 | A1 | 9/2013 | Grauzer et al. |
| 2013/0241147 | A1 | 9/2013 | McGrath |
| 2013/0300059 | A1 | 11/2013 | Sampson et al. |
| 2013/0337922 | A1 | 12/2013 | Kuhn |
| 2014/0027979 | A1 | 1/2014 | Stasson et al. |
| 2014/0094239 | A1 | 4/2014 | Grauzer et al. |
| 2014/0103606 | A1 | 4/2014 | Grauzer et al. |
| 2014/0138907 | A1 | 5/2014 | Rynda et al. |
| 2014/0145399 | A1 | 5/2014 | Krenn et al. |
| 2014/0171170 | A1 | 6/2014 | Krishnamurty et al. |
| 2014/0175724 | A1 | 6/2014 | Huhtala et al. |
| 2014/0183818 | A1 | 7/2014 | Czyzewski et al. |
| 2014/0309006 | A1 | 10/2014 | Shigeta |
| 2014/0346732 | A1 | 11/2014 | Blaha et al. |
| 2015/0021242 | A1 | 1/2015 | Johnson |
| 2015/0069699 | A1 | 3/2015 | Blazevic |
| 2015/0196834 | A1 | 7/2015 | Snow |
| 2015/0238848 | A1 | 8/2015 | Kuhn et al. |
| 2015/0251079 | A1 | 9/2015 | Wright |
| 2015/0290528 | A1 | 10/2015 | Sampson et al. |
| 2015/0290529 | A1 | 10/2015 | Bourbour et al. |
| 2017/0157499 | A1 | 6/2017 | Krenn et al. |
| 2018/0085658 | A1 | 3/2018 | Telsen et al. |
| 2018/0089956 | A1 | 3/2018 | Nagaragatta et al. |

FOREIGN PATENT DOCUMENTS

| | | | |
|---|---|---|---|
| AU | 697805 | B2 | 10/1998 |
| AU | 757636 | B2 | 2/2003 |
| CA | 2266555 | A1 | 9/1996 |
| CA | 2284017 | A1 | 9/1998 |
| CA | 2612138 | A1 | 12/2006 |
| CN | 2051521 | U | 1/1990 |
| CN | 1341245 | A | 3/2002 |
| CN | 1824356 | A | 8/2006 |
| CN | 2848303 | Y | 12/2006 |
| CN | 2855481 | Y | 1/2007 |
| CN | 1933881 | A | 3/2007 |
| CN | 2877425 | Y | 3/2007 |
| CN | 101025603 | A | 8/2007 |
| CN | 101044520 | A | 9/2007 |
| CN | 200954370 | Y | 10/2007 |
| CN | 200987893 | Y | 12/2007 |
| CN | 101099896 | A | 1/2008 |
| CN | 101127131 | A | 2/2008 |
| CN | 101134141 | A | 3/2008 |
| CN | 201085907 | Y | 7/2008 |
| CN | 201132058 | Y | 10/2008 |
| CN | 201139926 | Y | 10/2008 |
| CN | 101437586 | A | 5/2009 |
| CN | 100571826 | C | 12/2009 |
| CN | 1771077 | B | 6/2010 |
| CN | 102125756 | A | 7/2011 |
| CN | 102170944 | A | 8/2011 |
| CN | 101783011 | B | 12/2011 |
| CN | 102847311 | A | 1/2013 |
| CN | 202724641 | U | 2/2013 |
| CN | 202983149 | U | 6/2013 |
| CZ | 24952 | U1 | 2/2013 |
| DE | 0291230 | C | 4/1916 |
| DE | 2816377 | A1 | 10/1979 |
| DE | 3807127 | A1 | 9/1989 |
| DE | 2757341 | A1 | 9/1998 |
| EP | 0777514 | B1 | 2/2000 |
| EP | 1502631 | A1 | 2/2005 |
| EP | 1713026 | A1 | 10/2006 |
| EP | 1194888 | A1 | 8/2009 |
| EP | 2228106 | A1 | 9/2010 |
| EP | 1575261 | B1 | 8/2012 |
| FR | 2375918 | A1 | 7/1978 |
| GB | 289552 | A | 4/1928 |
| GB | 337147 | A | 9/1929 |
| GB | 414014 | S | 7/1934 |
| GB | 672616 | A | 5/1952 |
| JP | 10063933 | A | 3/1998 |
| JP | 11045321 | A | 2/1999 |
| JP | 2000251031 | A | 9/2000 |
| JP | 2001327647 | A | 11/2001 |
| JP | 2002165916 | A | 6/2002 |
| JP | 2003154320 | A | 5/2003 |
| JP | 2003250950 | A | 9/2003 |
| JP | 2005198668 | A | 7/2005 |
| JP | 2006-092140 | A | 4/2006 |
| JP | 2008246061 | A | 10/2008 |
| JP | 4586474 | B2 | 11/2010 |
| TW | M335308 | U | 7/2008 |
| TW | M359356 | U | 6/2009 |
| TW | I345476 | B2 | 7/2011 |
| WO | 8700764 | A1 | 2/1987 |
| WO | 9221413 | A1 | 12/1992 |
| WO | 9528210 | A1 | 10/1995 |
| WO | 9607153 | A1 | 3/1996 |
| WO | 9710577 | A1 | 3/1997 |
| WO | 9814249 | A1 | 4/1998 |
| WO | 9840136 | A1 | 9/1998 |
| WO | 9943404 | A1 | 9/1999 |
| WO | 9952610 | A1 | 10/1999 |
| WO | 9952611 | A1 | 10/1999 |
| WO | 200051076 | A1 | 8/2000 |
| WO | 0156670 | A1 | 8/2001 |
| WO | 0178854 | A3 | 10/2001 |
| WO | 0205914 | A1 | 1/2002 |
| WO | 01/78854 | A3 | 2/2002 |
| WO | 03004116 | A1 | 1/2003 |
| WO | 03026763 | A1 | 4/2003 |
| WO | 2004067889 | A1 | 12/2004 |
| WO | 2004112923 | A1 | 12/2004 |
| WO | 2006031472 | A2 | 3/2006 |
| WO | 2006039308 | A2 | 4/2006 |
| WO | 2008005285 | A2 | 1/2008 |
| WO | 2008005286 | A2 | 1/2008 |
| WO | 2008006023 | A2 | 1/2008 |
| WO | 2008091809 | A2 | 7/2008 |
| WO | 2009067758 | A1 | 6/2009 |
| WO | 2009137541 | A2 | 11/2009 |
| WO | 2010052573 | A2 | 5/2010 |
| WO | 2010055328 | A2 | 5/2010 |

(56) References Cited

FOREIGN PATENT DOCUMENTS

| | | | |
|---|---|---|---|
| WO | 2010117446 | A2 | 10/2010 |
| WO | 2012/053074 | A1 | 4/2012 |
| WO | 2013019677 | A2 | 2/2013 |
| WO | 2016/049619 | A1 | 3/2016 |
| WO | 2016058085 | A9 | 4/2016 |

OTHER PUBLICATIONS

DVD labeled Morrill Decl. Ex. A is (see Binder 4-1, p. 149/206, Morrill Decl., para. 2.): A video (16 minutes) that the attorney for CARD, Robert Morrill, made to describe the Roblejo prototype card shuffler. DVD sent to Examiner by US Postal Service with this PTO/SB/08 form.

DVD labeled Solberg Decl.Ex.C, which is not a video at all, is (see Binder 4-1, p. 34/206, Solberg Decl., para.8): Computer source code for operating a computer-controlled card shuffler (an early Roblejo prototype card shuffler) and descriptive comments of how the code works. DVD sent to Examiner by US Postal Service with this PTO/SB/08 form.

DVD labeled Luciano Decl. Ex. K is (see Binder 2-1, p. 215/237, Luciano Decl., para. 14): A video demonstration (11minutes) of a Luciano Packaging prototype shuffler. DVD sent to Examiner by US Postal Service with this PTO/SB/08 form.

Shuffle Master, Inc. (1996). Let It Ride, The Tournament, User Guide, 72 pages.

Philippines Patent Application Formality Examination Report—Philippines Patent Application No. 1-2006-000302, dated Jun. 13, 2006.

"Playtech Retail begins roll out of Neon across Grosvenos 55 UK Casinos". Playtech, Apr. 21, 2016. Retrieved on Oct. 11, 2016 from the Internet: <URL: https://www.playtech.com/news/latest_news_and_prs/playtech_retail_begins_roll_out_of_neon_across_grosvenor_s_55_uk_casinos> (1 page).

Press Release for Alliance Gaming Corp., Jul. 26, 2004—Alliance Gaming Announces Control with Galaxy Macau for New MindPlay Baccarat Table Technology, 2 pages, http://biz.yahoo.com/prnews.

Prototype Glossary and Timelines; *Shuffle Tech International* v. *Scientific Games Corp., et al.* 1:15-cv-3702 (N.D. III.); undated; (May 2018) pp. 1-4.

Scarne's Encyclopedia of Games by John Scarne, 1973, "Super Contract Bridge", p. 153.

Shuffle Master Gaming, Service Manual, ACETM Single Deck Card Shuffler, (1998), 63 pages.

Shuffle Master Gaming, Service Manual, Let It Ride Bonus® With Universal Keypad, 112 pages, @ 2000 Shuffle Master, Inc.

Service Manual/User Manual for Single Deck Shufflers: BG1, BG2 and BG3 by Shuffle Master @1997, 151 page.

Singapore Patent Application Examination Report—Singapore Patent Application No. SE 2008 01914 A, dated Jun. 18, 2008. 9 pages.

SHFL Entertainment, Inc. Docket No. 60, Opening Claim Construction Brief, filed in Nevada District Court Case No. 2:12-cv-01782 with exhibits, Aug. 8, 2013, p. 1-125.

Shuffle Master's Reply Memorandum in Support of Shuffle Master's Motion for Preliminary Injunction for *Shuffle Master, Inc.* vs. *VendingData Corporation*, In the U.S. District Court, District of Nevada, No. CV-S-04-1373-JCM-LRL, Nov. 29, 2004.

Solberg, Halvard; Deposition; *Shuffle Tech International* v. *Scientific Games Corp., et al.* 1:15-cv-3702 (N.D. III.); Oct. 18, 2016; pp. 187, 224-246, 326-330, 338-339, 396; Baytowne Reporting; Panama City, FL.

Statement of Relevance of Cited References, Submitted as Part of a Third-Party Submission Under 37 CFR 1.290 on Dec. 7, 2012 (12 pages).

"TableScanner (TM) from ADVANSYS", Casino Inside Magazine, No. 30, pp. 34-36 (Dec. 2012) (4 pages).

TableScanner "Accounting & Cage". Product Information Datasheets [online]. Advansys, 2013. Retrieved on Oct. 11, 2016 from the Internet: <URL: http://advansys.si/products/tablescanner/accounting-cage/> (4 pages).

TableScanner "Casino Management System". Product Information Datasheets [online]. Advansys, 2013. Retrieved on Oct. 11, 2016 from the Internet: <URL: http://advansys.si/> (6 pages).

TableScanner "Multisite". Product Information Datasheets [online]. Advansys, 2013. Retrieved on Oct. 11, 2016 from the Internet: <URL: http://advansys.si/products/tablescanner/multisite/> (3 pages).

TableScanner "Player Tracking". Product Information Datasheets [online]. Advansys, 2013. Retrieved on Sep. 23, 2016 from the Internet: <URL: http://advansys.si/products/tablescanner/player-tracking/> (4 pages).

TableScanner "Table Management system". Product Information Datasheets [online]. Advansys, 2013. Retrieved on Oct. 11, 2016 from the Internet: <URL: http://advansys.si/products/tablescanner/> (4 pages).

tbm=pts&hl=en Google Search for card handling device with storage area, card removing system pivoting arm and processor :http://www.google.com/?tbrn=pts&hl=en; Jul. 28, 2012, 2 pages.

Tracking the Tables, by Jack Bularsky, Casino Journal, May 2004, vol. 17, No. 5, pp. 44-47.

"TYM @ A GLANCE—Table Games Yield Management", TYM LIVE Product Information Datasheets [online]. TANGAM Systems, 2016. Retrieved on Oct. 3, 2016 from the Internet: <URL: http://tangamgaming.com/wp-content/uploads/2016/12/TG_TYMGlance_2016-V4-1.pdf> (2 pages).

United States Court of Appeals for the Federal Circuit Decision Decided Dec. 27, 2005 for Preliminary Injuction for *Shuffle Master, Inc.* vs. *VendingData Corporation*, In the U.S. District Court, District of Nevada, No. CV-S-04-1373-JCM-LRL.

VendingData Corporation's Answer and Counterclaim Jury Trial Demanded for *Shuffle Master, Inc.* vs. *VendingData Corporation*, In the U.S. District Court, District of Nevada, No. CV-S-04-1373-JCM-LRL, Oct. 25, 2004.

VendingData Corporation's Opposition to Shuffle Master Inc.'s Motion for Preliminary Injection for *Shuffle Master, Inc.* vs. *VendingData Corporation*, In the U.S. District Court, District of Nevada, No. CV-S-04-1373-JCM-LRL, Nov. 12, 2004.

VendingData Corporation's Responses to Shuffle Master, Inc.'s First set of interrogatories for *Shuffler Master, Inc.* vs. *VendingData Corporation*, In the U.S. District Court, District of Nevada, No. CV-S-04-1373-JCM-LRL, Mar. 14, 2005.

Weisenfeld, Bernie; Inventor betting on shuffler; Courier-Post; Sep. 11, 1990; 1 page.

*Shuffle Tech International LLC et al.* vs. *Scientific Games Corporation et al.*, Order Denying Motion for Summary Judgement: Memorandum Opinion and Order, In the U.S. District Court, For The Northern District of Illinois Eastern Division, No. 15 C 3702, Sep. 1, 2017, 35 pages.

⅓" B/W CCD Camera Module EB100 by EverFocus Electronics Corp., Jul. 31, 2001, 3 pgs.

"ACE, Single Deck Shuffler," Shuffle Master, Inc., (2005), 2 pages.

Advansys, "Player Tracking" http://advansys.si/products/tablescanner/player-tracking/[Sep. 23, 2016 1:41:34 PM], 4 pages.

Australian Examination Report for Australian Application No. 2008202752, dated Sep. 25, 2009, 2 pages.

Australian Examination Report for Australian Application No. 2010202856, dated Aug. 11, 2011, 2 pages.

Australian Provisional Patent Application for Australian Patent Application No. PM7441, filed Aug. 15, 1994, Applicants: Rodney G. Johnson et al., Title: Card Handling Apparatus, 13 pages.

"Automatic casino card shuffle," Alibaba.com, (last visited Jul. 22, 2014), 2 pages.

Bally Systems Catalogue, Ballytech.com/systems, 2012, 13 pages.

Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 18 of 23 (color copies from Binder 1).

Documents submitted in the case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, Part 1 of 23 (Master Index and Binder 1, 1 of 2).

Documents submitted in the case of *Shuffle Master, Inc.* v. *Card Aurstia, et al.*, Case No. CV-N-0508-HDM-(VPC) Consolidated

(56) References Cited

OTHER PUBLICATIONS with Case No. CV-N-02-0244-ERC-(RAM)), May 6, 2003, Part 2 of 23 (Master Index and Binder 1, 2 of 2).
Documents submitted in the case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, Part 3 of 23 (Binder 2, 1 of 2).
Documents submitted in the case of Shuffle *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 4 of 23 (Binder 2, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 19 of 23 (color copies from Binder 3).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 5 of 23 (Binder 3, 1 of 2).
Documents submitted in the case of Shuffle *Shuffle Master, Inc.* v. *Card Aurstia, et al.*, Case No. CV-N-0508-HDM-(VPC) Consolidated with Case No. CV-N-02-0244-ERC-(RAM)), May 6, 2003, Part 6 of 23 (Binder 3, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 20 of 23 'color copies from Binder 4).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 7 of 23 (Binder 4, 1 of 2).
Documents submitted in the case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, Part 8 of 23 (Binder 4, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 21 of 23 color copies from Binder 6).
Documents submitted in the case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, Part 10 of 23 (Binder 6, 2 of 2).
Documents submitted in the case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, Part 9 of 23 (Binder 5 having No contents; Binder 6, 1 of 2).
Documents submitted in the case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, Part 11 of 23 (Binder 7, 1 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 12 of 23 (Binder 7, 2 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 13 of 23 (Binder 8, 1 of 5).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 22 of 23 color copies from Binder 8, part 1 of 2).
Documents submitted in the case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, Part 14 of 23 (Binder 8, 2 of 5).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 23 of 23 (color copies from Binder 8, part 2 of 2).
Documents submitted in the case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, Part 15 of 23 (Binder 8, 3 of 5).
Documents submitted in the case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, Part 16 of 23 (Binder 8, 4 of 5).
Documents submitted in the case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, Part 17 of 23 (Binder 8, 5 of 5).
"Error Back propagation," http://willamette.edu~gorr/classes/cs449/backprop.html (4 pages), Nov. 13, 2008.
"i-Deal," Bally Technologies, Inc., (2014), 2 pages.
"shufflers—SHFL entertainment," Gaming Concepts Group, (2012), 6 pages.
"TAG Archives: Shuffle Machine," Gee Wiz Online, (Mar. 25, 2013), 4 pages.
Canadian Office Action for CA 2,580,309 dated Mar. 20, 2012 (6 pages).
Canadian Office Action for Canadian Application No. 2,461,726, dated Jul. 19, 2010, 3 pages.
Canadian Office Action for Canadian Application No. 2,461,726, dated Dec. 11, 2013, 3 pages.
Casino Trac Table Trac Services. Product Information Datasheet [online]. CasinoTrac, 2015. Retrieved on Oct. 12, 2016 from the Internet: <URL: http://www.tabletrac.com/?pageid=15#prettyPhoto> (3 pages).
Christos Stergiou and Dimitrios Siganos, "Neural Networks," http://www.doc.ic.ac.uk/~nd/surprise_96/journal/vol4/ cs11/report.html (13 pages), Dec. 15, 2011.
Complaint filed in the matter of *SHFL entertainment, In.* v. *DigiDeal Corporation*, U.S. District Court, District of Nevada, Civil Action No. CV 2:12-cv-01782-GMC-VCF, Oct. 10, 2012, 62 pages.
Connect2Table Administrator Manual, Jan. 7, 2013 (82 pages).
Connect2Table Quick Installation Guide, Feb. 20, 2013 (36 pages).
Connect2Table Connect2Table System Summary, generated Oct. 21, 2016 (2 pages).
Connect2Table User Manual, Feb. 7, 2013 (35 pages).
European Search Report for European Application No. 12 152 303, dated Apr. 16, 2012, 3 pages.
European Patent Application Search Report—European Patent Application No. 06772987.1, dated Dec. 10, 2009, 5 pages.
European Examination Report for European Application No. 02 780 410, dated Jan. 25, 2010, 5 pages.
European Examination Report for European Application No. 02 780 410, dated Aug. 9, 2011, 4 pages.
Fine, Randall A., "Talking Tables", dated Apr. 25, 2012. Global Gaming Business Magazine, vol. 11, No. 5, May 2012. Retrieved on Oct. 3, 2016 from the Internet: <URL: https://ggbmagazine.com/issue/vol-11-no-5-may 2012/article/talking-tables> (4 pages).
Genevieve Orr, CS-449: Neural Networks Willamette University, http://www.willamette.edu/~gorr/classes/cs449/intro.html (4 pages), Fall 1999.
Gola, Steve; Deposition; *Shuffle Tech International* v. *Scientific Games Corp., et al.* 1:15-cv-3702 (N.D. III.); Oct. 13, 2016; pp. 1, 9-21, 30-69, 150-167, 186-188, 228-231, 290-315, 411; Henderson Legal Services, Inc.; Washington, DC.
Gros, Roger; New Card Management System To Be Tested At Bally's Park Place; Casino Journal; Apr. 1989; 5 pages.
http://www.google.com/search?tbm=pts&q=Card+handling+devicve+with+input+and+outpu . . . Jun. 8, 2012.
http://www.ildado.com/casino_glossary.html, Feb. 1, 2001, p. 1-8.
https://web.archive.org/web/19991004000323/http://travelwizardtravel.com/majon.htm, Oct. 4, 1999, 2 pages.
http://www.google.com/search?tbm=pts&q=shuffling+zone+onOopposite+site+of+input+ . . . Jul. 18, 2012.

(56) References Cited

OTHER PUBLICATIONS

Litwiller, Dave, CCD vs. CMOS: Facts and Fiction reprinted from Jan. 2001 Issue of Photonics Spectra, Laurin Publishing Co. Inc. (4 pages).
Malaysian Patent Application Substantive Examination Adverse Report—Malaysian Patent Application Serial No. PI 20062710, dated May 9, 2009, 4 pages.
NEON Product Information Datasheets [online]. "Enterprise Casino Management, Table Management System, Mobile, Gaming". Intelligent Gaming, 2014. Retrieved on Oct. 12, 2016 from the Internet: <URL: http://www.intelligentgaming.co.uk/products/neon-enterprise/> (4 pages).
Olsen, Eddie; Automatic Shuffler ready' for Atlantic City experiment; Blackjack Confidential; Jul./Aug. 1989; pp. 6-7.
PCT International Preliminary Examination Report for International Patent Application No. PCT/US02/31105 dated Jul. 28, 2004, 9 pages.
PCT International Search Report for International Application No. PCT/US2003/015393, dated Oct. 6, 2003, 2 pages.
PCT International Search Report and Written Opinion, PCT/US2012/48706, dated Oct. 16, 2012, 12 pages.
PCT International Search Report for PCT/US2005/034737 dated Apr. 7, 2006, 1 page.
PCT International Search Report for PCT/US2007/022894, dated Jun. 11, 2008, 3 pages.
PCT International Search Report and Written Opinion of the International Searching Authority for PCT/US2010/001032, dated Jun. 16, 2010, 11 pages.
PCT International Search Report and Written Opinion for PCT/US07/15035, dated Sep. 29, 2008, 6 pages.
PCT International Search Report and Written Opinion for PCT/US07/15036, dated Sep. 23, 2008, 6 pages.
PCT International Search Report and Written Opinion, PCT Application No. PCT/US2015/051038, dated Jan. 22, 2016, 11 pages.
PCT International Search Report and Written Opinion of the International Searching Authority for PCT/US2008/007069, dated Sep. 8, 2008, 10 pages.
PCT International Search Report and Written Opinion, PCT Application No. PCT/US2015/022158, dated Jun. 17, 2015, 13 pages.
PCT International Search Report and Written Opinion for International Application No. PCT/US2007/023168, dated Sep. 12, 2008, 8 pages.
PCT International Search Report and Written Opinion, PCT Application No. PCT/US2015/040196, dated Jan. 15, 2016, 20 pages.
PCT International Search Report and Written Opinion, PCT Application No. PCT/US2013/062391, dated Dec. 17, 2013. 13 pages.
PCT International Search Report and Written Opinion of the International Searching Authority for PCT/US05/31400, dated Sep. 25, 2007, 12 pages.
PCT International Search Report and Written Opinion, PCT Application No. PCT/US2015/025420, dated Oct. 2, 2015, 15 pages.
PCT International Search Report and Written Opinion of the International Searching Authority for PCT/US13/59665, dated Apr. 25, 2014, 21 pages.
PCT International Search Report and Written Opinion of the International Searching Authority for PCT/IB2013/001756, dated Jan. 10, 2014, 7 pages.
PCT International Search Report and Written Opinion of the International Searching Authority for PCT/US11/59797, dated Mar. 27, 2012, 14 pages.
PCT International Search Report and Written Opinion for International Application No. PCT/US2007/022858, dated Mar. 7, 2008, 7 pages.
PCT International Search Report and Written Opinion for International Patent Application No. PCT/US2006/22911, dated Jun. 1, 2007, 6 pages.
PCT International Search Report and Written Opinion of the International Searching Authority for PCT/GB2011/051978, dated Jan. 17, 2012, 11 pages.
DVD labeled Luciano Decl. Ex. K is (see Binder 2-1, p. 215/237, Luciano Decl., para.14): A video demonstration (11minutes) of a Luciano Packaging prototype shuffler. DVD sent to Examiner by US Postal Service with copy of this PTO/SB/08 form.
International Search Report from International Application No. PCT/US2019/027460, dated Aug. 12, 2019, 4 pages.
International Written Opinion from International Application No. PCT/US2019/027460, dated Aug. 12, 2019, 9 pages.
Chinese Second Office Action for Chinese Application No. 201980065003.4, dated Nov. 2, 2023, 22 pages with translation.

* cited by examiner

CARD-HANDLING DEVICES AND RELATED METHODS, ASSEMBLIES, AND COMPONENTS

TECHNICAL FIELD

The disclosure relates to card-handling devices and related assemblies, components, and methods. In particular, embodiments of the disclosure relate to card-handling devices, card input portions of card-handling devices, card output portions of card-handling devices, card-shuffling carousels of card-handling devices, and methods of shuffling cards.

BACKGROUND

Wagering games are often based on the outcome of randomly generated arrangements of cards. Such games are widely played in gaming establishments and, often, a single deck or multiple decks of fifty-two (52) playing cards may be used to play the game. Gaming using multiple decks of playing cards may include, for example, six to ten decks used in games such as blackjack and baccarat and two decks of playing cards used in games such as double deck blackjack. Many other specialty games may use single or multiple decks of cards, with or without jokers and with or without selected cards removed.

From the perspective of players, the time the dealer must spend shuffling diminishes the excitement of the game. From the perspective of casinos, shuffling time reduces the number of hands played and specifically reduces the number of wagers placed and resolved in a given amount of time, consequently reducing casino revenue. Casinos would like to increase the amount of revenue generated by a game without changing the game or adding more tables. One option to increase revenue is to decrease the time the dealer spends handling and shuffling playing cards. This may be accomplished by using one set of cards to administer the game while shuffling a second set of cards. Other options include decreasing shuffling time.

The desire to decrease shuffling time has led to the development of mechanical and electromechanical card-shuffling devices. Such devices increase the speed of shuffling and dealing, thereby increasing actual playing time. Such devices also add to the excitement of a game by reducing the amount of time the dealer or house must spend preparing to play the game.

However, the card output area or shoe used in conjunction with shufflers often places strain on dealers' hands and wrists by using card distribution interfaces to output cards that are oriented at a substantial acute angle relative to the table surface. To draw cards from these shoes, dealers often must twist their wrists repeatedly at awkward and uncomfortable angles. Moreover, shoes often are not easily adjustable to meet a dealer's card drawing preference (e.g., direction in which dealers prefer to draw a card relative to the table).

Card counting is also a significant problem, for example, when using automatic card shufflers or hand shuffling. Casinos often lose a house advantage when players can predict what cards remain to be dealt and the proximity of those cards to being dealt. It is desirable for casinos to reduce or eliminate the ability for players to count cards. Continuous shuffling machines assist in reducing the ability to count cards, but additional ways to eliminate card counting and improve ergonomics of card delivery may be desirable.

BRIEF SUMMARY

Some embodiments of the present disclosure may include a card-handling device including a playing card-shuffling apparatus and a card rotation device. The card rotation device may be configured to rotate one or more playing cards about a minor axis of the one or more playing cards to alter an orientation of lateral edges of the one or more playing cards. The minor axis of the one or more playing cards extends through a thickness of the one or more playing cards in a direction transverse to a longitudinal axis and a lateral axis of the one or more playing cards. The card rotation device may be configured to rotate the one or more playing cards as at least one of the one or more playing cards enters the shuffling apparatus.

Some embodiments of the present disclosure may include a card-handling device including a card input configured to rotate at least one playing card from a group of playing cards about a minor axis of the at least one playing card to alter an orientation of lateral edges of the at least one playing card. The minor axis of the at least one playing card extends through the thickness of the at least one playing card in a direction transverse to a longitudinal axis and lateral axis of the at least one playing card. The card input may be configured to enable the at least one playing card to be provided to a card-shuffling apparatus for shuffling playing cards after the orientation of the at least one playing card has been altered.

Some embodiments of the present disclosure may include a card-handling device configured to be mounted at or proximate a gaming surface. The card-handling device may include a card-shuffling apparatus and a card rotation device. The card rotation device may be configured to receive playing cards in a substantially flat orientation and alter an orientation of a leading edge of at least some of the playing cards while maintaining at least some of the playing cards in the substantially flat orientation.

Some embodiments of the present disclosure may include a card-handling device configured to be positioned at a gaming structure having a playing surface. The card-handling device may include a card-shuffling apparatus and a card output portion. The card output portion may be configured to receive playing cards from the card-shuffling apparatus when the card output portion is in a first position. The playing cards may be positioned by the card-shuffling apparatus to be received into the card output portion with major faces of the playing cards oriented in a plane substantially transverse to the playing surface. The card output portion may be further configured to transport the playing cards to a second position where at least a portion of the card output portion is accessible from the playing surface.

Some embodiments of the present disclosure may include a method of shuffling cards. The method may include inputting cards into a card rotation device. The method may include rotating the card rotation device about a minor axis of the cards to alter an orientation of lateral edges of the cards to randomize an orientation of the lateral edges of the cards. The minor axis of the cards extends through a thickness of the cards in a direction transverse to a longitudinal axis and a lateral axis of the cards. The method may further include transporting the cards from the card rotation device into a card-shuffling apparatus. The method may include outputting at least one card from the card-shuffling apparatus into a card output area.

Some embodiments of the present disclosure may include a method of shuffling cards. The method may include inputting cards into a card-handling device in an orientation substantially parallel to a horizontal plane. The method may include transporting the cards to a card-shuffling apparatus. The method may further include outputting the cards into a card output area in an orientation substantially perpendicular to the horizontal plane.

Some embodiments of the present disclosure may include a card-handling device including a card-shuffling apparatus. The card-shuffling apparatus may include a carousel having a number of compartments, for example, at least one hundred compartments. The compartments may be arranged radially about the carousel and configured to hold between one and ten cards in each compartment.

Some embodiments of the present disclosure may include a card-shuffling carousel including compartments arranged radially about the carousel. The compartments may be configured to hold at least one card. The compartments may include an aperture defined by at least two arms and a resilient material. The resilient material may extend between a bottom retention and a top retention in at least one of the at least two arms. The resilient material may have a length greater than a distance between the bottom retention and the top retention. At least one of the bottom retention and the top retention may be a movable connection.

Some embodiments of the present disclosure include a card-handling device for use with a gaming surface. The card-handling device may include a retractable card input portion, a transportation device, a card-shuffling apparatus, and a card outlet. The retractable card input portion may be configured to receive playing cards in an orientation substantially parallel to the gaming surface. The transportation device may be configured to transfer the playing cards from the retractable card input portion to the card-shuffling apparatus within the card-handling device. The card outlet may be configured to receive the playing cards from the card-shuffling apparatus and deliver the playing cards to a location proximate the gaming surface in an orientation substantially transverse to the gaming surface.

Some embodiments of the present disclosure may include a card-handling device configured to be positioned at least partially below a gaming table upper surface. The card-handling device may include a card intake area, a card-shuffling apparatus, and an output area. The card intake area may be configured to feed cards into the card-shuffling apparatus in an orientation substantially parallel to a surface of the gaming table. The output area may be configured to receive the cards from the card-shuffling apparatus in an orientation substantially transverse to the surface of the gaming table in an area beneath the surface of the gaming table and transport the cards to an area at least partially above the surface of the gaming table.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

Figure 1:
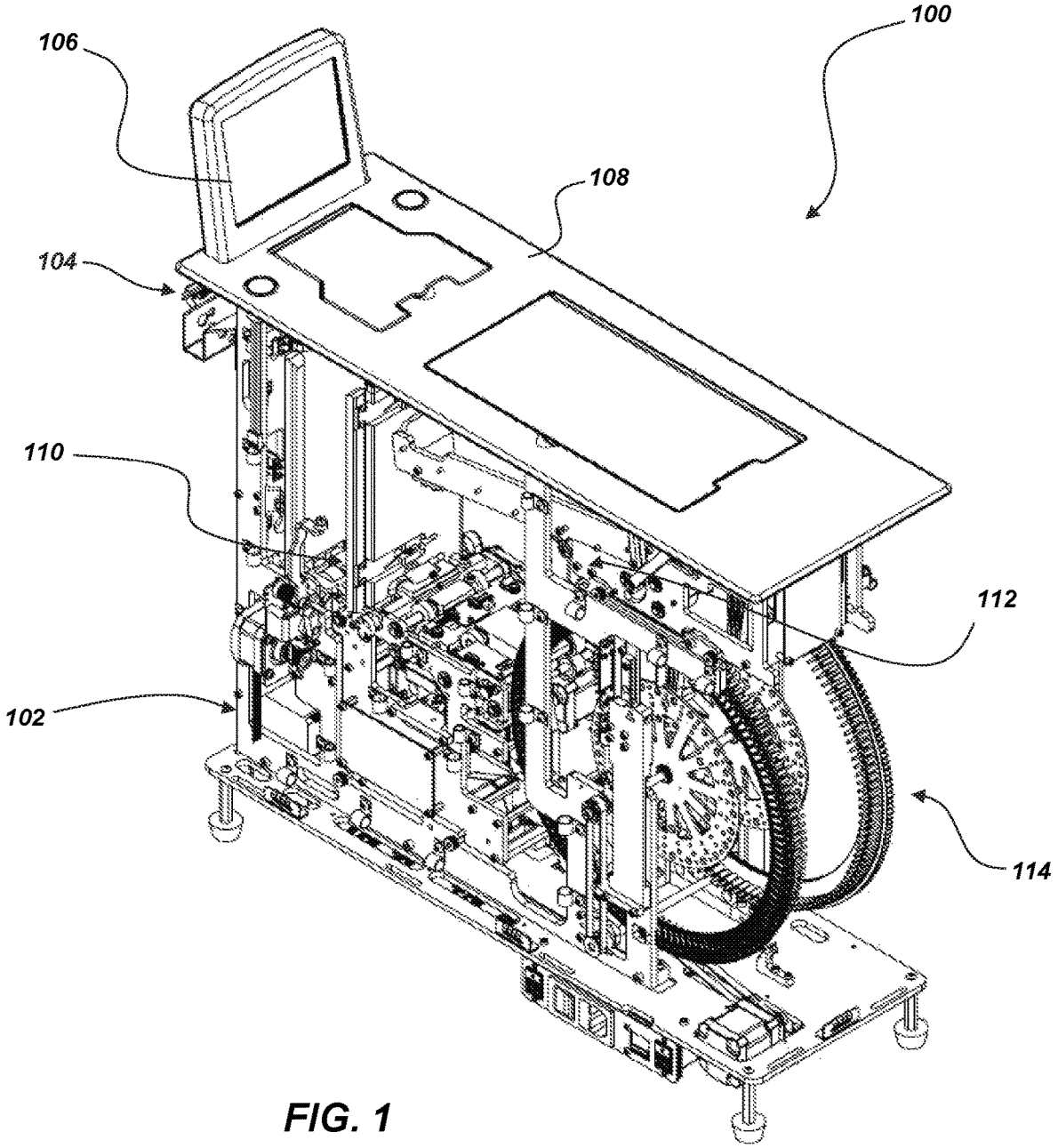
FIG. 1 shows an isometric view of an embodiment of the present disclosure with covers removed to show the internal mechanism.

The illustrations presented herein are not meant to be actual views of any particular card-handling device or component thereof but are merely idealized representations employed to describe illustrative embodiments. The drawings are not necessarily to scale. Elements common between figures may retain the same numerical designation.

As used herein, any relational term, such as "first," "second," "over," "beneath," "top," "bottom," "underlying," "up," "down," etc., is used for clarity and convenience in understanding the disclosure and accompanying drawings and does not connote or depend on any specific preference, orientation, or order, except where the context clearly indicates otherwise. For example, these terms may refer to an orientation of elements of the card-handling device relative to a surface of a table on which the card-handling device may be positioned, mounted, and/or operated (e.g., as illustrated in the figures).

As used herein, the terms "vertical" and "horizontal" may refer to a drawing figure as oriented on the drawing sheet and are in no way limiting of orientation of an apparatus, or any portion thereof, unless it is apparent that a particular orientation of the apparatus is necessary or desirable for operation in view of gravitational forces. For example, when referring to elements illustrated in the figures, the terms "vertical" or "horizontal" may refer to an orientation of elements of the card-handling device relative to a table surface of a table to which the card-handling device may be mounted and operated.

As used herein, the term "and/or" means and includes any and all combinations of one or more of the associated listed items.

As used herein, the terms "substantially," "approximately," or "about" in reference to a given parameter means and includes to a degree that one skilled in the art would understand that the given parameter, property, or condition is met with a degree of variance, such as within acceptable manufacturing tolerances, or wherein the variance is with respect to a general parameter, such as an orientation. For example, a parameter that is substantially met may be at least about 90% met, at least about 95% met, or even at least about 99% met.

Some embodiments of the present disclosure may include card-handling devices having a card rotation device (e.g., rotatable card input portion, rotatable card intake, rotating elevator, rotating card input device, etc.). The card rotation device may rotate playing cards about a minor axis, normal to a face of the cards, such that an orientation of the lateral edges of the playing cards may be randomized, for example, before entering a shuffling apparatus. Randomizing the orientation of the lateral edges of the playing cards may work to prevent some forms of card manipulation, card recognition, or card counting that are becoming more prevalent in games involving playing cards, for example, by recognizing any visual edge variations (e.g., edge sorting), differences, and/or anomalies, from manufacture, handling, or intentional marking.

Some embodiments of the present disclosure may include a card output storage area (e.g., area where the playing cards are stored after exiting the shuffling apparatus and before entering the gaming area) that stores the playing cards in a substantially horizontal stack. The cards may exit the shuffling apparatus in a substantially vertical orientation (e.g., where a major face of the cards lies in a plane normal to the gaming area). The card output storage area may receive the cards in substantially the same orientation as the cards exiting the shuffling apparatus. A horizontal card output storage area may provide additional storage space allowing the use of greater numbers of decks over existing designs and may allow for more compact designs providing more efficient use of space.

Some embodiments may include a shuffling apparatus capable of handling greater numbers of cards than conventional designs. The shuffling apparatus may include multiple compartments for holding cards. In some embodiments, the compartments may include a securing element and a card-handling aperture to make more efficient use of space allowing for a more compact arrangement of the compartments and provide an increased capacity for the shuffling apparatus. In some embodiments, the compartments may be modular, which may result in efficiency improvements especially for repair and replacement of compartments.

FIG. 1 shows a perspective view of a card-handling device 100, according to an embodiment of the present disclosure, having portions of one or more housings (e.g., covers) of the card-handling device 100 removed to show interior components of the card-handling device 100. The card-handling device 100 may be configured to be mounted with at least a majority of the card-handling device 100 beneath a level of a gaming structure, for example, a table surface (e.g., a gaming table surface) of a table (e.g., a gaming table) and to deliver shuffled playing cards to the table surface and/or receive playing cards to be shuffled from or proximate the table surface. The card-handling device 100 may include a frame structure 102, a control system 104 in communication with one or more displays 106, and a substantially flat top surface 108 that may be substantially co-planar with the table surface when placed for use with the table.

Figure 2:
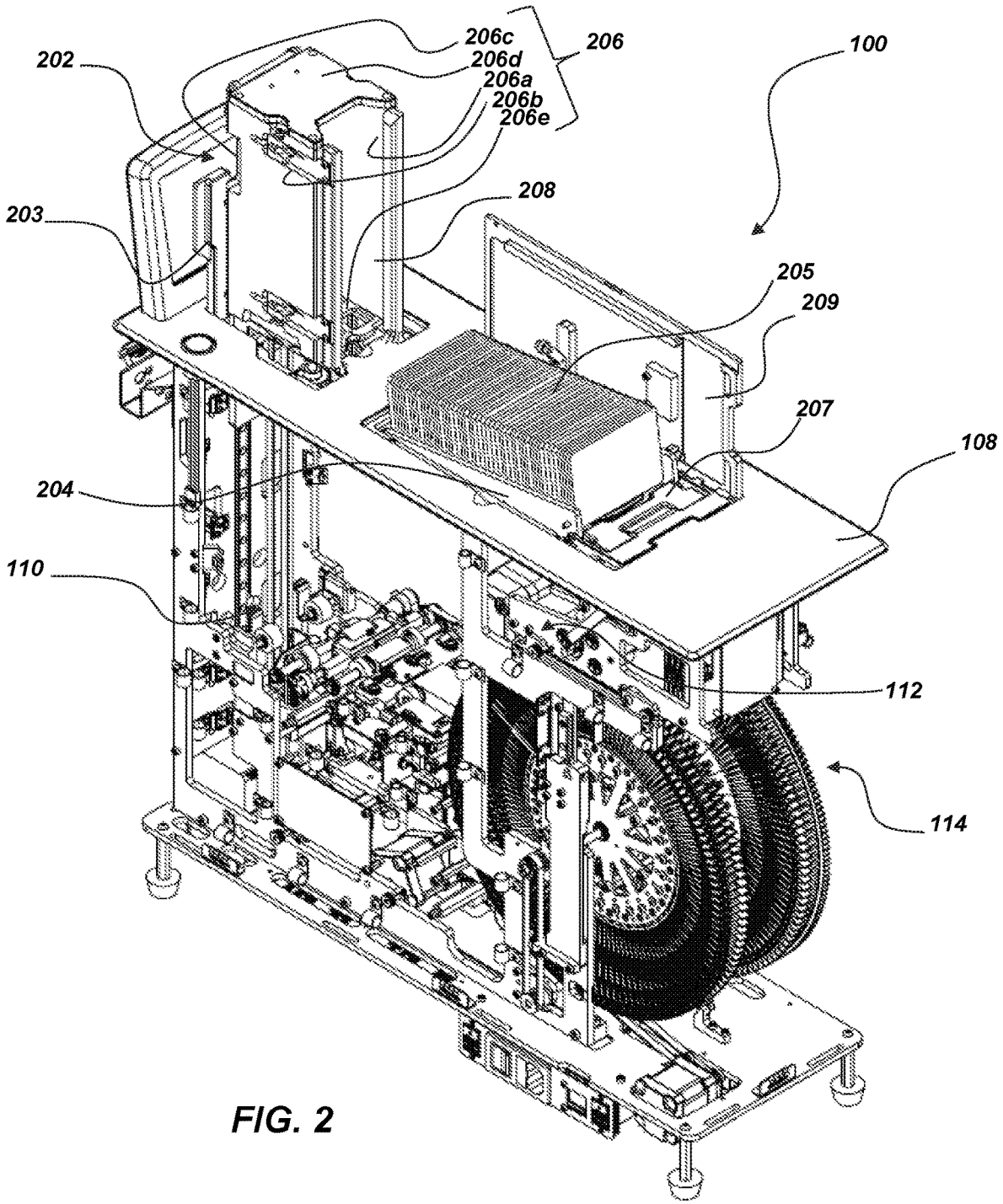
FIG. 2 shows an isometric view of an embodiment of the present disclosure with covers removed to show the internal mechanism.

FIG. 2 shows a perspective view of the card-handling device 100, according to an embodiment of the present disclosure, having portions of one or more housings (e.g., covers) of the card-handling device 100 removed to show interior components of the card-handling device 100. The card-handling device 100 may include a card input portion 110 and a card output portion 112. In some embodiments, the card input portion 110 may be configured to move (e.g., elevate) a card intake area 202 toward (e.g., above) the top surface 108 when an operator (e.g., dealer) needs to interact with the card input portion 110, such as, for example, to insert playing cards that are ready to be shuffled into the card intake area 202. The card input portion 110 may retract the card intake area 202 below the top surface 108, as shown in FIG. 1, when the operator does not need to interact with the card input portion 110, or when the playing cards collected in the card intake area 202 are to be shuffled. In some embodiments, the card output portion 112 may be configured to elevate an card outlet 204 and hold a group of shuffled cards 205 above the top surface 108 when an operator needs to interact with the card output portion 112, such as, for example, to remove playing cards 205 that have been shuffled from the card outlet 204 or to enter the cards 205 into game play (e.g., dealing or drawing). The card outlet 204 may retract the card outlet 204 below the top surface 108, as shown in FIG. 1, when the operator does not need to interact with the card outlet 204, or when the playing cards collected in the card-shuffling apparatus 114 have been shuffled and are ready to be inserted into the card outlet 204 for reentry into game play.

In some embodiments, the card intake area 202 may have a partially enclosed internal volume, for example, defined by at least two walls 206. For example, the card intake area 202 may have a first sidewall 206*a* and a second sidewall 206*b*, such that the playing cards can only be placed in the card intake area 202 in one orientation. In some embodiments, the card intake area 202 may include a back wall 206*c* to regulate the uniformity of the stack of playing cards in the card intake area 202 by providing a uniform stop when cards are placed in the card intake area 202. In some embodiments, the card intake area may include a top wall 206*d* (e.g., top wall 206*d*, which may be rotatable to open an upper portion of the card intake area 202) and or a bottom wall 206*e* further defining the intake area. In some embodiments, the card intake area 202 may include an open face 208 sized and configured to enable cards to be placed within the card intake area 202. In some embodiments, the open face 208 may be a front face of the card intake area 202. In some embodiments, the open face may be a top face. In other embodiments, the open face may be more than one face of the card intake area 202, such as, for example, the front face and a side face, wherein the card intake area 202 is defined by a first sidewall 206*a* and a back wall 206*c*, a first sidewall 206*a*, a back wall 206*c*, and a top wall 206*d*, or any other combination of walls 206. In some embodiments, the card intake area 202 may be defined by walls 206 on every face. For example, the card intake area may be defined by a first sidewall 206*a*, a second sidewall 206*b*, a back wall 206*c*, a top wall 206*d*, a bottom wall 206*e*, and a front wall. In some embodiments, at least one of the walls 206 may include an open area (e.g., slot, aperture, hole, cutout, or gap) and/or may be movable to enable the playing cards to be inserted into the card intake area. In some embodiments, the sidewalls 206*a*, 206*b* may coincide with a long dimension of the playing cards (e.g., longitudinal axis) and the back wall 206*c* may coincide with a short dimension of the playing cards (e.g., lateral axis).

In some embodiments, the card intake area 202 may be configured to hold up to 650 playing cards, such as, between about 50 playing cards and about 650 playing cards, or between about 500 playing cards and about 600 playing cards, or about 520 playing cards (e.g., about ten decks of cards with or without extra cards, such as wild or other special cards).

In some embodiments, the card intake area 202 and card outlet 204 may be configured to elevate and retract relative to the top surface 108 of the card-handling device 100. The card intake area 202 and card outlet 204 may retract below the gaming surface, such that the card-handling device 100, with the exception of display 106, has a minimal, if any, profile above the gaming surface, as shown in FIG. 1 (e.g., may be positioned entirely below the top surface 108). A lid 203 may open and close to enable the card intake area 202 to be elevated over the top surface 108 and to enclose the card intake area 202 in the card-handling device 100 when the card intake area 202 is retracted. In some embodiments, the lid 203 may rotate between open and closed positions (e.g., on a hinge). In other embodiments, the lid 203 may move in a different manner, for example, the lid 203 may be coupled to the card intake area 202 (e.g., at top wall 206*d*) and may translate above the top surface 108 as the card intake area 202 is elevated. An outlet lid 209 may open and close to enable the card outlet 204 to be elevated over the top surface 108 and to enclose the card output portion 112 in the card-handling device 100 when the card outlet 204 is retracted. In some embodiments, the outlet lid 209 may rotate between open and closed positions. In other embodiments, the outlet lid 209 may move in a different manner, for example, the lid 209 may be coupled to the card outlet 204 and may translate above the top surface 108 as the card outlet 204 is elevated.

Maintaining a low profile while not in use may reduce the area required for the card-handling device in or adjacent to gaming tables, which may reduce the size required for a gaming table to occupy. In some embodiments, the card-handling device 100 may have a profile such that the top surface 108 may be incorporated into the gaming surface with the game being played on at least a portion of the top surface 108 of the card-handling device 100, which may result in the dedicated space for the card-handling device 100 in the surface of the gaming table being reduced and/or eliminated. In other embodiments, the card-handling device may be placed adjacent to a gaming table on the dealer side thereof and supported by the gaming table via a bracket system or on the casino floor with height-adjustable legs or a pedestal.

Figure 3:
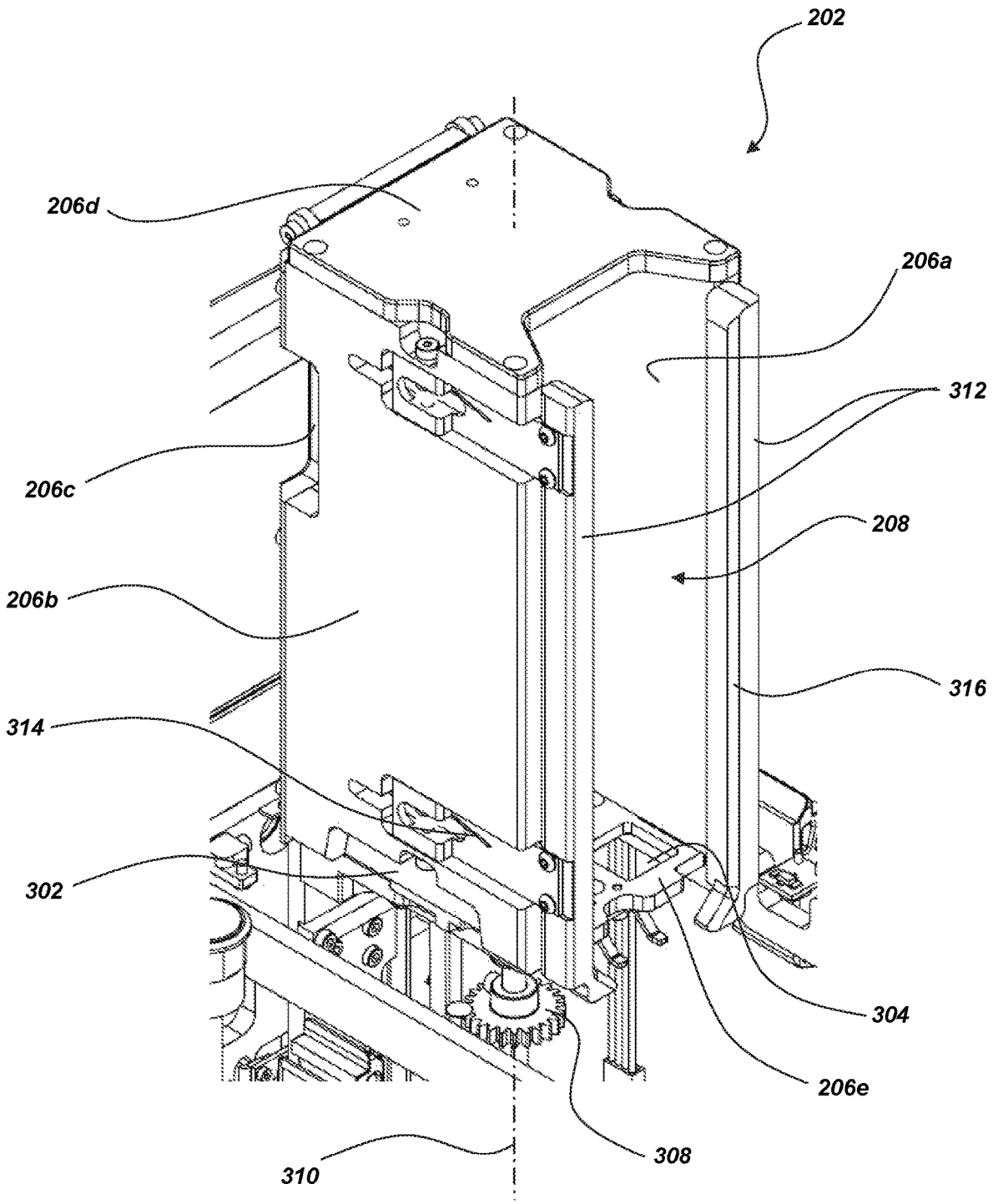
FIG. 3 shows an isometric view of a card intake area according to an embodiment of the present disclosure.

FIG. 3 shows an isometric view of the card intake area 202 of the card-handling device 100 in an elevated position. In some embodiments, the card intake area 202 may include at least one sidewall 206*a*, 206*b*, a back wall 206*c*, a top wall 206*d*, and a bottom wall 206*e*. In some embodiments, a gap 302 may be defined between at least one of the sidewalls 206*a*, 206*b* and the bottom wall 206*e* (e.g., both of the sidewalls 206*a*, 206*b*). The gap 302 may be large enough that at least one card may pass through the gap 302 in order to be moved further into the card-handling device 100 for a shuffling operation. In some embodiments, the gap 302 may be defined in at least one of a back wall 206*c* and/or a front wall.

In some embodiments, the bottom wall 206*e* may include at least one aperture 304 (e.g., void, opening, hole, etc.). In some embodiments, the at least one aperture 304 may allow the card input portion 110 (FIG. 2) of the card-handling device 100 (FIG. 2) to interface with unshuffled cards stored within the card intake area 202. For example, a pick-off roller 610 (FIG. 6) may protrude through the at least one aperture 304 to interface with at least one card that may be resting on the bottom wall 206*e* in order to move the at least one card through the gap 302 and out of the card intake area 202.

In some embodiments, the card intake area 202 includes an open face 208 for receiving unshuffled cards. In some embodiments, the open face 208 may include retention brackets 312 configured to secure the cards within the card intake area 202. For example, the retention brackets 312 may be automated such that, when the card intake area 202 arrives in the elevated position, the retention brackets 312 may open providing a substantially enlarged area in the open face 208 for inputting unshuffled cards. Before the card intake area 202 retracts, the retention brackets 312 may close at least partially blocking the open face 208 such that the unshuffled cards when in a horizontal position cannot be inserted or removed through the open face 208. The retention brackets 312 may then secure the unshuffled cards within the card intake area 202 during the elevating and/or retracting motion of the card intake area 202. In some embodiments, the retention brackets 312 may be manually operated by the operator. For example, the operator may input a command into the control system 104 (FIG. 1, which may include an input and a display) to open and/or close the retention brackets 312 or the operator may directly manipulate the retention brackets 312 between open and closed or secured positions.

In some embodiments, the retention brackets 312 may have biasing elements 314 (e.g., springs, resilient members, compressible fluid, etc.) configured to bias the retention brackets 312 toward a closed position. In some embodiments, the retention brackets 312 may have an angular face 316, such that, when the operator inserts the unshuffled cards between the retention brackets 312 the retention brackets 312 are forced into an open position by the interface between the unshuffled cards and the angular face 316 of the retention brackets 312. The biasing elements 314 may return the retention brackets 312 to a closed position after the unshuffled cards have passed through the open face 208 between the retention brackets 312.

In some embodiments, the card intake area 202 may include a rotational input 308 (e.g., spindle, gear, shaft, differential, motor, gearbox, or cog). The rotational input 308 may be configured to rotate the card intake area 202 about a vertical axis 310 of the card intake area 202. In some embodiments, the vertical axis 310 may coincide with a minor axis of the unshuffled cards retained within the card intake area 202. The minor axis of the unshuffled cards may extend through a thickness of the unshuffled cards in a direction transverse to a longitudinal axis and a lateral axis of the unshuffled cards (e.g., axes extending along the major faces of the cards). For example, the thickness may extend from a front major face of the card to a back major face of the card.

In some embodiments, the rotational input 308 may be configured to rotate the card intake area 202 when in an elevated position and/or in a retracted position. For example, the rotational input 308 may be configured to rotate the card intake area 202 while transitioning from the elevated position to the retracted position and/or while transitioning from the retracted position to the elevated position.

As depicted, the rotational input 308 may be a gear (e.g., cog, spline, helical gear, tapered gear, etc.). In some embodiments, the rotational input 308 may remain disengaged when the card intake area 202 is not in the retracted position.

For example, the rotational input 308 may engage a rotational drive 502 (FIG. 5) (e.g., actuation system, motor and input gear, gearbox, clutch, electronic spindle, etc.) at the retracted position where the rotational drive 502 (FIG. 5) may drive the rotational input 308 rotating the card intake area 202.

In other embodiments, the rotational input 308 may be remain engaged (e.g., be permanently engaged) with a gearbox configured to input rotation into the rotational input 308 in the elevated position, the retracted position or at any point during the transition between the elevated position and/or the retracted position.

Figure 4:
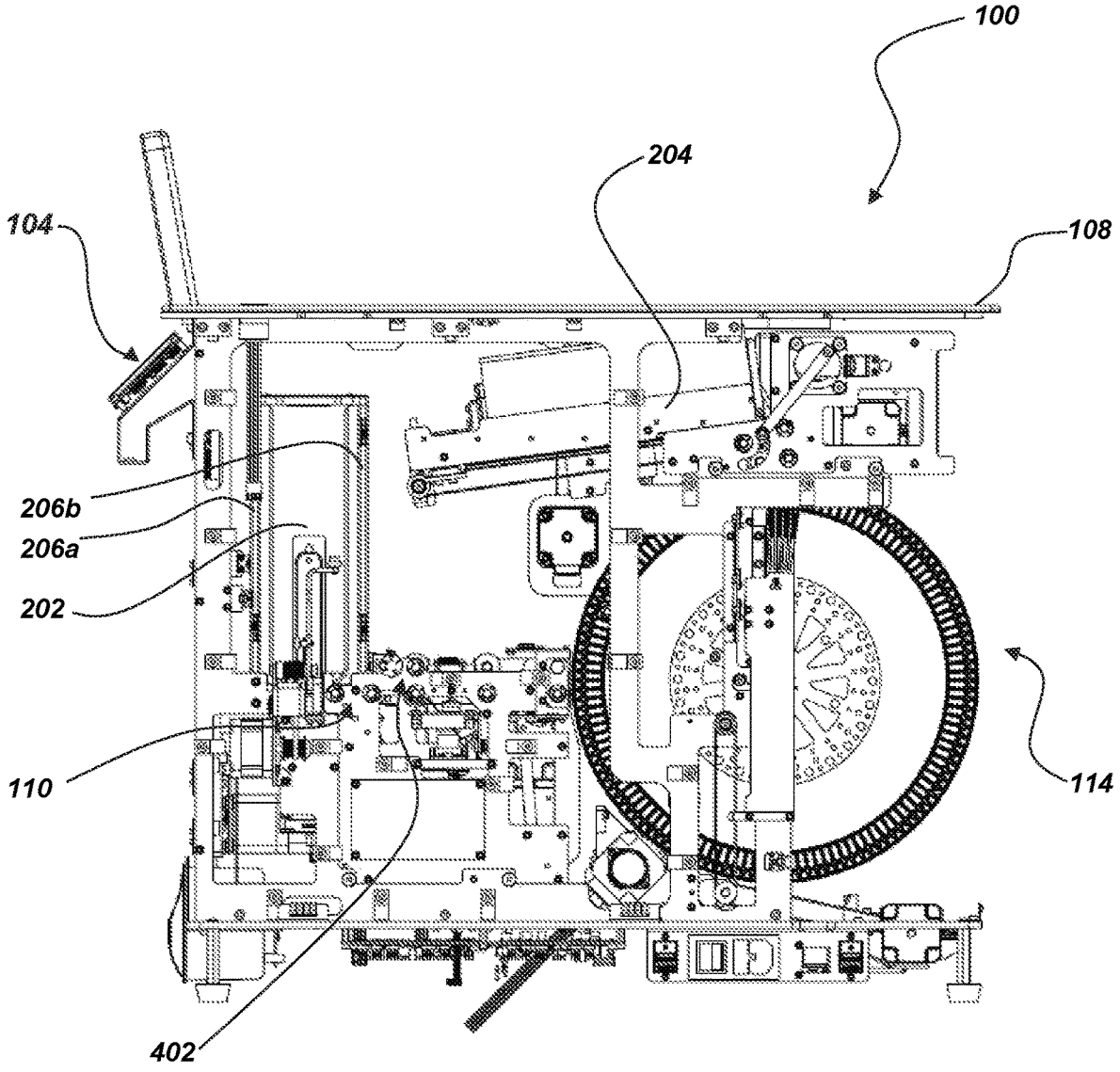
FIG. 4 shows an elevational side view of an embodiment of the present disclosure with covers removed to show the internal mechanism.

FIG. 4 shows an elevational side view of the card-handling device 100 with the card intake area 202 in a retracted position within the card-handling device 100. In some embodiments, the card intake area 202 may rotate such that, in the retracted position, the sidewalls 206*a*, 206*b* are in a front and back location relative to the card-handling device 100. For example, the card intake area 202 may rotate at least 90°, such as, for example, ±90°, ±270° as the card intake area 202 retracts into the retracted position and/or after the card intake area 202 is in the retracted position. In some embodiments, when the card intake area 202 is in the retracted position the card intake area 202 may be integrated into the card input portion 110. In some embodiments, the card input portion 110 may include a first card feed system 402 configured to transport the playing cards from the card intake area 202 to the card-shuffling apparatus 114.

The playing cards may exit the card intake area 202 through the one of the gaps 302 (FIG. 3) in the sidewalls 206*a*, 206*b* (e.g., the gap 302 facing a first card feed system 402 leading to a shuffling apparatus). The card intake area 202 may rotate at least 180° after one or more playing cards are removed from the card intake area 202, altering which sidewall 206*a*, 206*b* and corresponding gap 302 is facing the first card feed system 402. For example, a selected number of playing cards may be removed from the card intake area 202 through the gap 302 in sidewall 206*a*. After the one or more playing cards are removed from the card intake area 202, the card intake area 202 may rotate 180° such that sidewall 206*b* is facing the first card feed system 402. When the sidewall 206*b* is facing the first card feed system 402, an additional card or cards may be removed through the gap 302 in the sidewall 206*b*. As discussed below in greater detail, such a configuration may be utilized to randomize a side or edge of the cards at least partially as they appear on one side of a group of cards (e.g., a leading edge of the card that is visible to players as it protrudes out of a card shoe).

Figure 5:
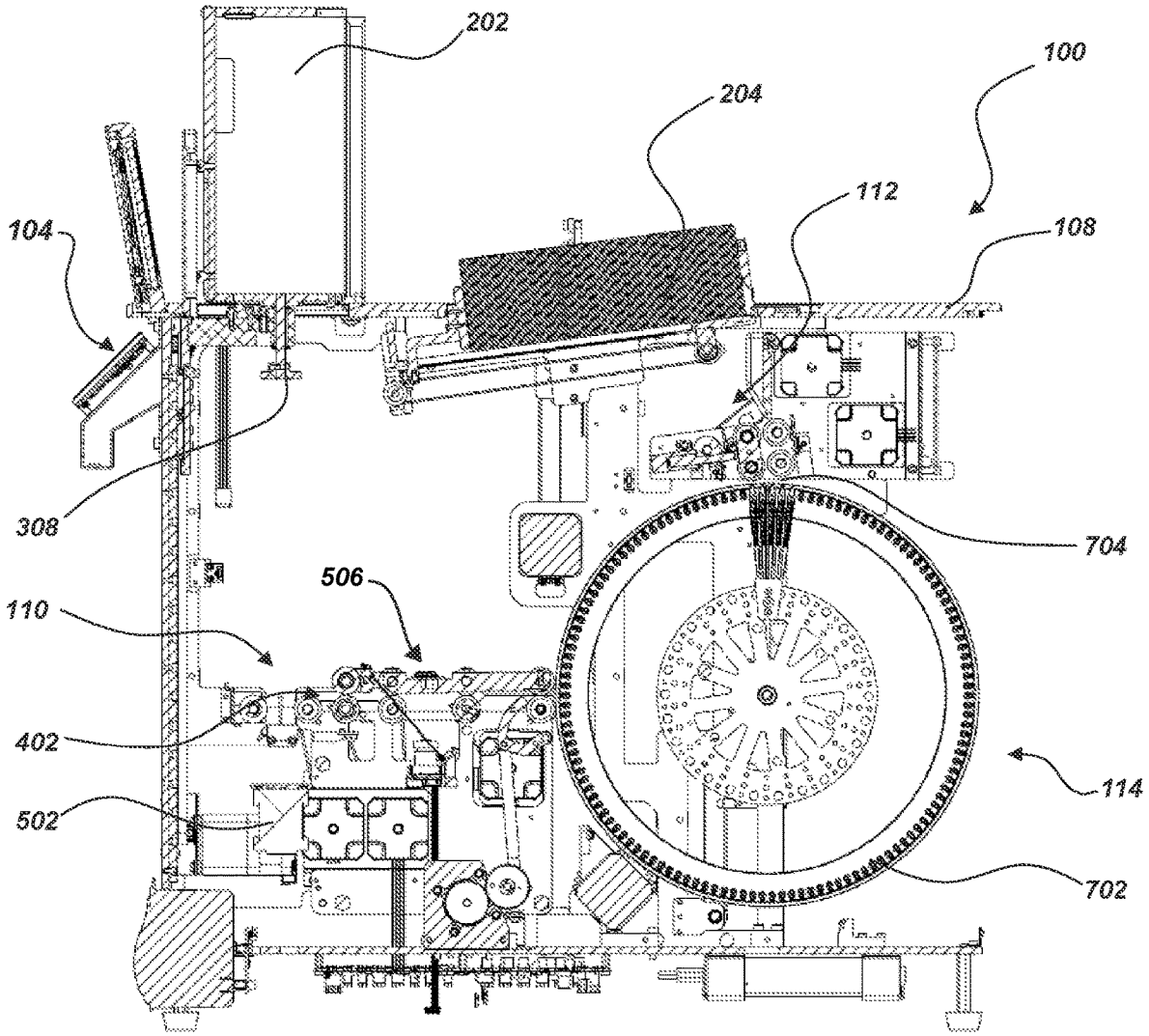
FIG. 5 show a section view of an elevational side view of an embodiment of the present disclosure.

FIG. 5 is an elevational side section view of the card-handling device 100 with both the card intake area 202 and the card outlet 204 in the elevated position. As depicted, the rotational drive 502 for the card intake area 202 may remain integral to the other components of the card input portion 110, such as the first card feed system 402. The rotational drive 502 may only engage the rotational input 308 when the card intake area 202 is in the retracted position. In some embodiments, the first card feed system 402 may be substantially aligned in a substantially horizontal plane. For example, the playing cards may exit the card intake area 202 in a substantially horizontal plane and may continue through the first card feed system 402 and into the card-shuffling apparatus 114 in the same substantially horizontal plane.

Figure 6:
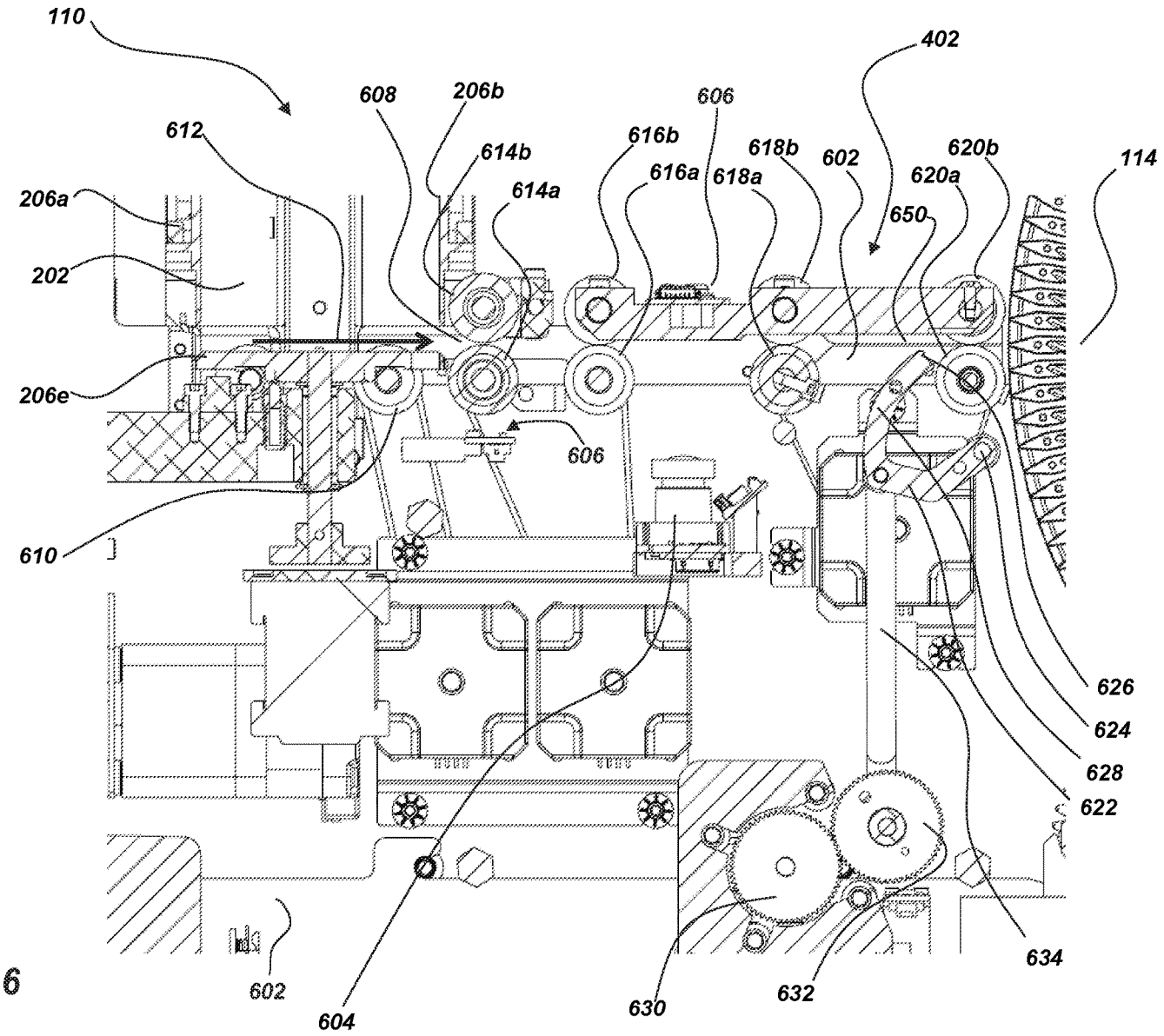
FIG. 6 shows an enlarged view of a section view of a card input portion according to an embodiment of the present disclosure.

FIG. 6 shows an enlarged view of the card input portion 110 from the side section view of the card-handling device 100. The card input portion 110 may include the first card feed system 402, a first frame assembly 602, a card-imaging system 604, and one or more sensors 606. The first card feed system 402 may include a first card pathway 608 (e.g., pathway along which playing cards move through the card input portion 110). The first card pathway 608 may lead from the card intake area 202 of the card input portion 110 to the card-shuffling apparatus 114 (e.g., a carousel). The first card feed system 402 may include a set of pick-off rollers 610 that may transport playing cards individually from the card intake area 202 to the first card pathway 608 in a direction indicated by arrow 612. In some embodiments, the pick-off rollers 610 may protrude through the at least one aperture 304 (FIG. 3) in the bottom wall 206*e* of the card intake area 202. The pick-off rollers 610 may remove the playing cards individually from a bottom area of the card intake area 202 through the gaps 302 (FIG. 3) in the sidewalls 206*a*, 206*b*. Additional pairs of rollers 614*a*, 614*b*, 616*a*, 616*b*, 618*a*, 618*b*, 620*a*, and 620*b* may act to displace playing cards from the card intake area 202 to the card-shuffling apparatus 114 (e.g., one card at a time). For example, a stack of unshuffled playing cards may be placed in the card intake area 202, and the set of pick-off rollers 610 of the first card feed system 402 may remove playing cards (e.g., individually) from a bottom of (e.g., beneath) the stack of unshuffled playing cards and pass the playing cards to the additional pairs of rollers 614*a*, 614*b*, 616*a*, 616*b*, 618*a*, 618*b*, 620*a*, and 620*b*. The additional pairs of rollers 614*a*, 614*b*, 616*a*, 616*b*, 618*a*, 618*b*, 620*a*, and 620*b* may transport the playing cards to the card-shuffling apparatus 114. As discussed above, the card intake area 202 may be configured to receive one or more decks of playing cards (e.g., one, two, four, six, eight, ten decks of cards, etc.) at a time.

In some embodiments, the card-imaging system 604 may be oriented along the first card pathway 608 of the first card feed system 402. The first card feed system 402 may transport playing cards past the card-imaging system 604, and the card-imaging system 604 may capture identifying information of each playing card as each playing card moves along the first card pathway 608 before insertion into the card-shuffling apparatus 114. For example, the card-imaging system 604 may include a camera or line scanning device that captures an image or scan of each card. In some embodiments, the card-imaging system 604 may comprise one or more of the imaging devices described in U.S. Pat. No. 7,933,448 to Downs, issued Apr. 26, 2011, in U.S. Pat. No. 7,764,836 to Downs et al., issued Jul. 27, 2010, or in U.S. Pat. No. 8,800,993 B2 to Blaha et al., issued Aug. 12, 2014, the disclosure of each of which is incorporated herein in its entirety by this reference. In some embodiments, the card-imaging system 604 may not need to capture an image of an entire card, but may detect only rank and suit information, indicia (e.g., markings) on the playing cards, such as, for example, a lot number, a casino identifier, a shoe number, a shift number, a table number, bar code, glyph, any other known type of special marking, or combinations thereof. In some embodiments, the control system 104 (FIG. 1) of the card-handling device 100 may receive signals from the card-imaging system 604 to determine rank and/or suit of each playing card being read or sensed by the card-imaging system 604. The control system 104 (FIG. 1) of the card-handling device 100 may store at least some data related to each playing card (e.g., an inventory of the playing cards handled by the card-handling device 100, a complete card set composition, etc.) in a memory portion of the control system 104 (FIG. 1). Stored data may be compared to data collected at the card-imaging system 604 or another location in the card-handling device 100. For example, the card-imaging system 604 may be used in conjunction with a second card-imaging system that may capture the same information in another location (e.g., the card-shuffling apparatus 114, an associated card-dispensing device, such as a shoe) or with stored values from a previous imaging event to keep an inventory of the playing cards and/or verify the constitution of a group of cards.

In some embodiments, the one or more sensors 606 of the card input portion 110 may be oriented proximate the card intake area 202 and may be used to sense whether playing cards are present in the card intake area 202 or whether playing cards are being passed from the card intake area 202 to the first card pathway 608. Furthermore, the sensor 606 may be configured to send signals to the control system 104 (FIG. 1) and inform the control system 104 (FIG. 1) that playing cards are present in the card intake area 202. Furthermore, the control system 104 (FIG. 1) may be configured to initiate a shuffling cycle (e.g., process of shuffling playing cards with the card-handling device 100) when the card intake area 202 is in the retracted position and the sensor 606 detects the presence of cards in the card intake area 202. In some embodiments, the sensor 606 may include at least one of an optical sensor and an infrared sensor.

In some embodiments, the card input portion 110 may include a restricted portion 650 of the first card pathway 608. For example, the restricted portion 650 may restrict a lateral and/or longitudinal dimension of the card pathway 608 in order to restrict unwanted movement (e.g., bending) of the cards as they moved toward and into the card-shuffling apparatus 114.

In some embodiments, the card input portion 110 may include an elongated packer arm 622. The elongated packer arm 622 may rotate about a packer arm shaft 624 and a pushing surface 626 of a pusher arm 628 of the elongated packer arm 622 may translate partially along the first card pathway 608 of the first card feed system 402 to ensure proper loading of the playing cards into the card-shuffling apparatus 114. A motor 630 may rotate an eccentric cam member 632, which may cause the elongated packer arm 622 to rock back and forth along an arc-shaped path through a connector link 634.

In some embodiments, the elongated packer arm 622 may be used to provide additional force to a playing card along the first card pathway 608 as the playing card leaves the pair of rollers 620*a*, 620*b*. For example, the elongated packer arm 622 may be located in the card-handling device 100 such that the pushing surface 626 of the pusher arm 628 of the elongated packer arm 622 may abut against a trailing edge of a playing card and force the playing card at least substantially completely into the card-shuffling apparatus 114. In some embodiments, the elongated packer arm 622 may be similar to the devices disclosed in the aforementioned U.S. Pat. Nos. 6,659,460, 7,766,332, and 8,800,993 B2, the disclosures of each of which are incorporated herein in their entireties by this reference.

Figure 7:
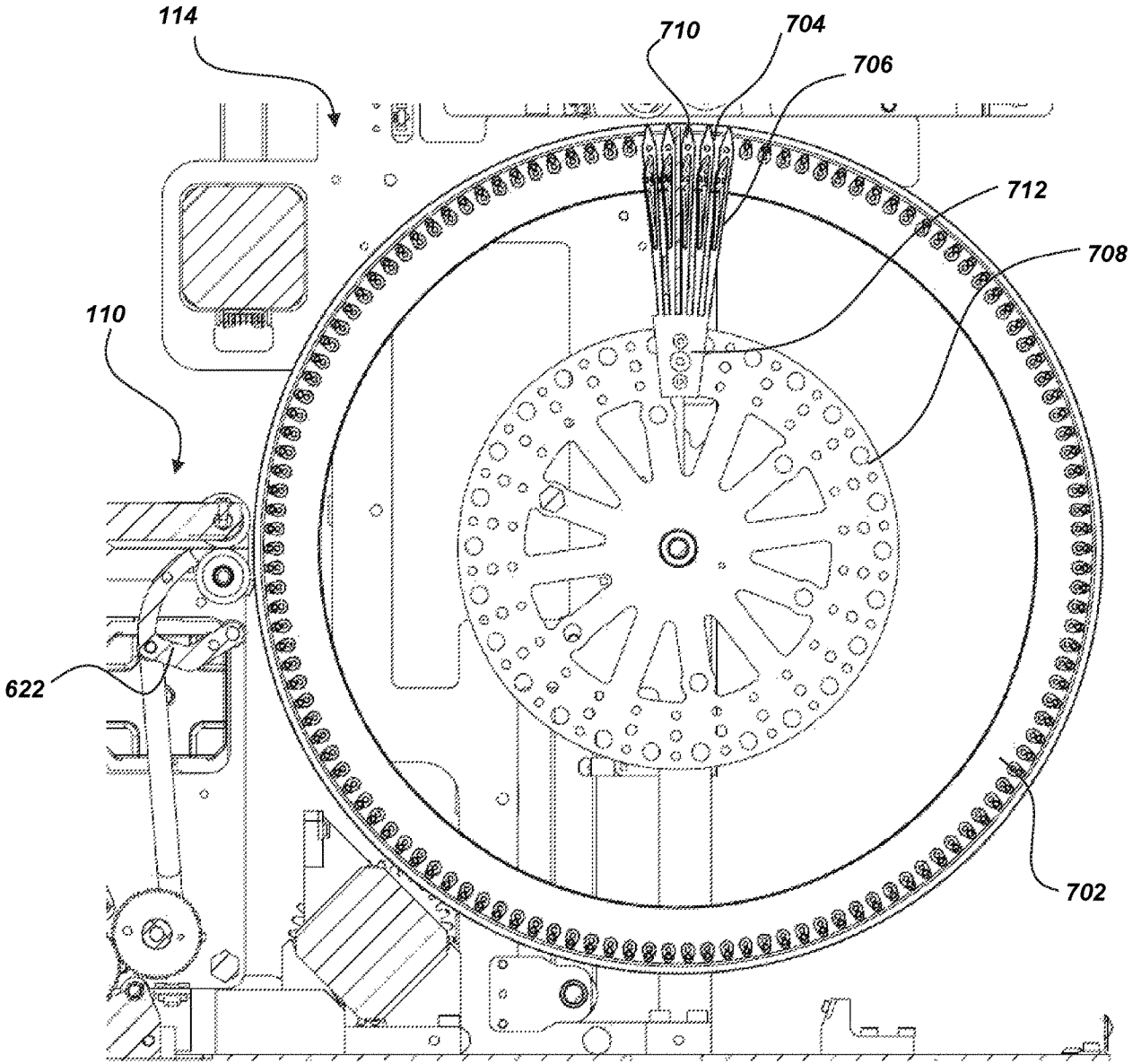
FIG. 7 shows an enlarged view of a section view of a card-shuffling apparatus according to an embodiment of the present disclosure.

FIG. 7 shows an enlarged view of the card-shuffling apparatus 114 from the cross-sectional side view of the card-handling device 100 of FIG. 5. In some embodiments, the card-shuffling apparatus 114 may include a multi-compartment carousel 702 and the packer arm 622. The multi-compartment carousel 702 may be circular in shape (e.g., annular). The multi-compartment carousel 702 of the card-shuffling apparatus 114 may have a number of compartments 704 (e.g., apertures, securing portions, etc.) defined between spaced pairs of adjacent fingers 706 (e.g., adjacent arms, etc.) extending from a rotatable center member 708. Each compartment 704 may be defined between two spaced pairs of adjacent fingers 706 of the multi-compartment carousel 702. The fingers 706 may each include a beveled edge 710 that enables and guides insertion of playing cards on top of or below playing cards previously deposited in the compartments 704 by the first card feed system 402 (FIG. 6) of the card input portion 110. The beveled edges 710 may include flat, angled surfaces or curved surfaces. Card edges of playing cards may contact the beveled edges 710 and may be deflected and guided into the compartments 704.

In some embodiments, the adjacent fingers 706 may include a biasing element (e.g., spring, leaf spring, inverted spring, inverted leaf spring, resilient member, etc.) providing biasing pressure between the adjacent fingers 706 for assisting in holding playing cards securely within the compartments 704 after the playing cards are inserted into the multi-compartment carousel 702. In some embodiments, each compartment 704 may be sized and shaped to hold between one and ten playing cards, such as between two and seven playing cards, between one and five playing cards or between four and five playing cards.

In some embodiments, the multi-compartment carousel 702 may have between about eighty or one hundred compartments and about two hundred compartments, such as between about one hundred compartments and about one hundred sixty compartments, between about one hundred twenty compartments and about one hundred forty compartments, or about one-hundred-thirty compartments. In some embodiments, the multi-compartment carousel 702 may be configured to hold up to six hundred fifty individual cards, such as between about fifty cards and about six hundred fifty cards, between about five hundred cards and about six hundred cards, or about five hundred twenty cards.

In some embodiments, the compartments 704 may be modular. For example, the multi-compartment carousel 702 may be defined by a number of compartment modules 712 extending radially from the rotatable center member 708. In some embodiments, the compartment modules 712 may be individually removable from the rotatable center member 708. For example, each compartment module 712 may be secured to the rotatable center member 708 with hardware (e.g., screws, bolts, nuts, studs, pins, etc.), clamps (e.g., toggle clamps, latch clamps, spring clamps, screw clamps, etc.), or latches (e.g., draw latch, pin and tube latch, toggle latch, barrel latch, rotary latch, etc.).

Figure 8:
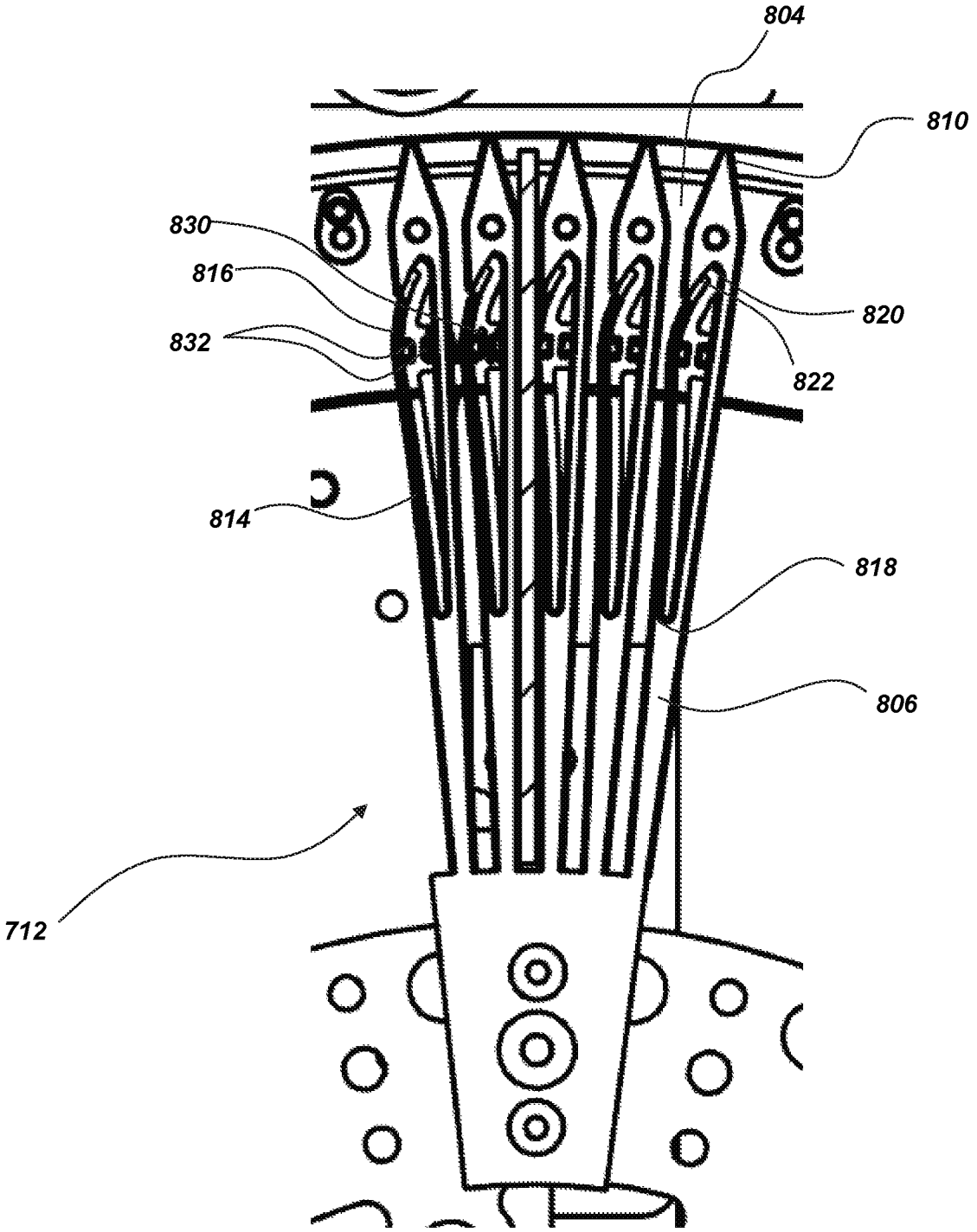
FIG. 8 shows an enlarged view of a compartment module according to an embodiment of the present disclosure.

FIG. 8 shows an enlarged view of a compartment module 712 of the multi-compartment carousel 702 of FIG. 7. In some embodiments, the compartment module 712 may include at least one aperture 804 defined between at least two arms 806. In some embodiments, the arms 806 may have a beveled leading edge 810 configured to guide playing cards into the apertures 804 between the arms 806.

In some embodiments, the arms 806 may include a biasing element 814 configured to secure the playing cards within the apertures 804. In some embodiments, the biasing element 814 may be formed from a resilient material configured to bow at least partially outward from the arm 806 intruding into the aperture 804. For example, the biasing element 814 may be a length of resilient material forming an arc with an apex 816 of the arc located within the aperture 804 in a direction away from the arm 806. In some embodiments, the biasing element 814 may be separate from the arm 806. The arm 806 may include a bottom retention 818 and a top retention 820 configured to retain the ends 822 of the biasing element 814. In some embodiments, the biasing element 814 may be a resilient material spanning between the top retention 820 and the bottom retention 818. In some embodiments, at least one of the top retention 820 and the bottom retention 818 may be configured to provide a floating retention of the biasing element 814 such that an end of the biasing element 814 may move relative to the arm 806. For example, the distal end 822 of the biasing element 814 may move inward away from the aperture 804 while still being restricted from moving outward into the aperture 804 beyond a selected distance. When the biasing element 814 is fully extended such that an apex 816 of the biasing element 814 is the largest distance from the arm 806, as permitted by the arms 806, the distal end 822 may be in a first position within the top retention 820. When playing cards are inserted into the aperture 804, the apex 816 may move toward the arm 806 and the floating retention in the top retention 820 may allow the distal end 822 of the biasing element 814 to move to a second position.

In some embodiments, at least one of the bottom retention 818 and the top retention 820 may be a fixed connection such that an end of the biasing element 814 in the bottom retention 818 and/or the top retention 820 may not be allowed to move relative to the arm 806. In some embodiments, the biasing element 814 may be integral to the arm 806 (e.g., formed from the same piece of material such that there is no definitive joint between the biasing element 814 and the arm 806) at the fixed connection. In some embodiments, the biasing element 814 may be formed from a different material and fixed to the arm 806 at the bottom retention 818 and/or the top retention 820. The biasing element 814 may be attached with hardware (e.g., pin, screw, bolt, etc.), adhesive (e.g., glue, epoxy, etc.), welding, soldering, or brazing.

In some embodiments, one of the bottom retention 818 and the top retention 820 may be a fixed connection while the other retention 818, 820 is a floating retention. For example, the bottom retention 818 may be a fixed connection and the top retention 820 may be a floating retention.

In some embodiments, the biasing element 814 may include a biasing support 830 (e.g., secondary biasing element, secondary spring, bump stop, damper, etc.). For example, the biasing support 830 may be positioned between the apex 816 and the arm 806. The biasing support 830 may be configured to provide additional support to the biasing element 814. In some embodiments, the biasing support 830 may be adjustable such that the securing pressure of the biasing element 814 and/or the biasing support 830 may be adjustable, such as, for example, by limiting the travel of the biasing element 814, increasing the resistance by preloading the biasing support (e.g., spring spacers, indexed seats, etc.), and/or otherwise altering the resistance of the biasing support (e.g., fluid pressure, damper valve adjustments, etc.). In some embodiments, the biasing support 830 may be a coil spring. In some embodiments, the biasing element 814 and/or the arm 806 may include seats 832 to locate or restrict movement of the biasing support 830 in at least one direction (e.g., in a lateral or axial direction). For example, the seats 832 may be pins and the biasing support 830 may define complementary geometry (e.g., hole, aperture, annular formation, etc.) to the pins such that the biasing support 830 is secured between the biasing element 814 and the arm 806.

In some embodiments, the apertures 804 may each include a sensor to determine when the aperture 804 is full (e.g., has the maximum number of playing cards it is configured to hold by sensing the position of the biasing element 814). In some embodiments, the sensor may include a pair of contacts, a magnetic switch, reed switch, pressure switch, proximity switch, etc. In some embodiments, the control system 104 (FIG. 1) may track the number of cards loaded into each aperture 804 and determine which apertures 804 are full based on the tracking information.

In some embodiments, the control system 104 (FIG. 1) may control which aperture 804 receives the playing cards and may determine which apertures 804 are full and which apertures 804 can receive playing cards. In some embodiments, the control system 104 may trigger the ejection of playing cards into the card output portion 112 (FIG. 2) responsive to information obtained and/or stored by the control system 104 (e.g., a record of where cards have been loaded in a shuffling event, input from the sensors, etc.). For example, the control system 104 (FIG. 1) may trigger the ejection based on a percentage of full apertures 804. In some embodiments, the control system 104 (FIG. 1) may trigger the ejection responsive to a number of full apertures 804, such as between about one hundred full apertures 804 and about two hundred full apertures 804, between about one hundred twenty full apertures 804 and about one hundred thirty full apertures 804, or about one hundred twenty-five full apertures 804. In some embodiments, the control system 104 (FIG. 1) may only trigger the ejection when every aperture 804 is full. In some embodiments, the control system 104 (FIG. 1) may trigger an ejection only from an aperture 804 that is full, resulting in ejection of cards only from full apertures 804.

Although the card-handling device 100 of the present disclosure describes the card-shuffling apparatus 114 including a multi-compartment carousel 702, the card-shuffling apparatus 114 may include any suitable shuffling mechanism such as, for example, those disclosed in U.S. Pat. No. 5,676,372 to Sines et al. that issued Oct. 14, 1997, U.S. Pat. No. 6,254,096 to Grauzer et al. that issued Jul. 3, 2001, U.S. Pat. No. 6,651,981 to Grauzer et al. that issued Nov. 25, 2003, and U.S. Pat. No. 6,659,460 to Blaha et al. that issued Dec. 9, 2003, the disclosures of each of which are incorporated herein in their entireties by this reference. In some embodiments, the card-shuffling apparatus 114 may have a wheel or carousel design that may be somewhat similar to the card-shuffling devices disclosed in the aforementioned and incorporated by reference U.S. Pat. No. 8,800,993 B2.

In some embodiments, the card-shuffling apparatus 114 may operate, in at least one operational mode, as a continuous shuffling machine. In other words, the card-shuffling apparatus 114 may be configured to continuously receive cards (e.g., after each round of play) and may continuously shuffle cards and provide cards to the dealer without unloading unused cards. In contrast, batch shuffling the one or more decks of cards involves unloading the entire set of cards after each shuffling cycle. For example, the card-shuffling apparatus 114 may shuffle the playing cards such that playing cards discarded and reinserted into the card-handling device 100 from a previous round have a chance of appearing (e.g., being dealt) in the next round.

In some embodiments, the card-shuffling apparatus 114 may operate, in at least one operational mode, as a batch shuffling machine or to verify and/or sort a group or deck of playing cards. For example, the card-shuffling apparatus 114 may be configured to shuffle a complete set or "shoe" of one or more decks of cards (e.g., one, two, four, six, eight, ten decks of cards, etc.) and then provide the cards from those decks to the dealer (e.g., one card at a time, one hand at a time, etc.) until the set of cards is depleted, or a cut card is reached.

Figure 9:
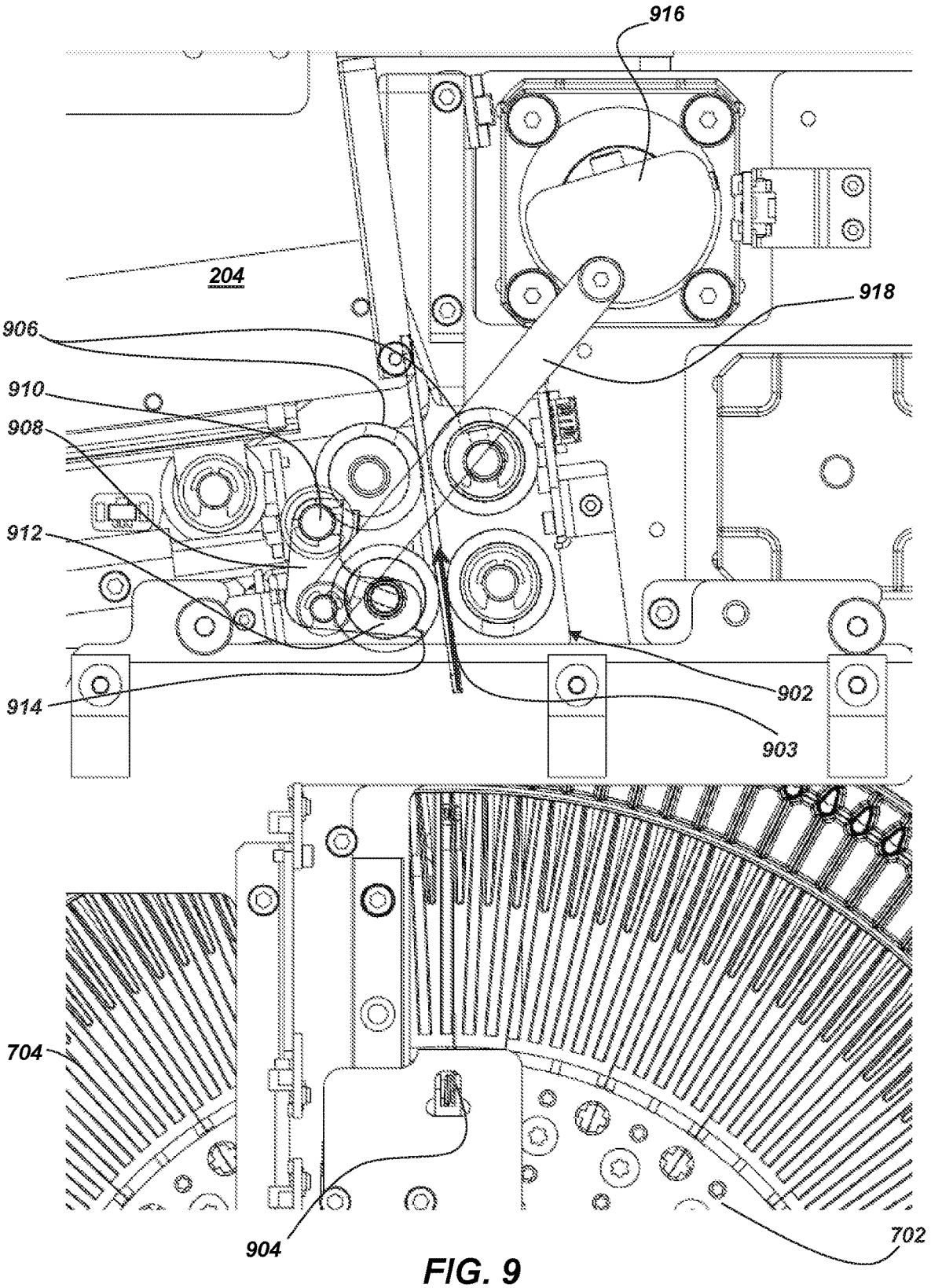
FIG. 9 shows an enlarged view of a card output portion according to an embodiment of the present disclosure with additional covers removed to show the internal mechanism.

FIG. 9 shows an enlarged view of the card output portion 112 of the card-handling device 100 (FIG. 1). A card transfer system 902 of the card-shuffling apparatus 114 may transfer playing cards from the multi-compartment carousel 702 to the card outlet 204 of the card output portion 112 of the card-handling device 100 along a second card pathway 903 when the card outlet 204 is in the retracted position. In some embodiments, the multi-compartment carousel 702 may include an ejector 904. The ejector 904 may be configured to unload the cards from the compartments 704 into the card transfer system 902. The ejector 904 may be configured to unload the compartments 704 in a compartment 704 by compartment 704 manner. For example, the ejector 904 may unload a first compartment 704 completely before unloading a second compartment 704. In some embodiments, the second compartment 704 may be a compartment 704 adjacent to the first compartment 704. In other embodiments, the second compartment 704 may be a randomly selected compartment 704 and may not be a compartment 704 adjacent to the first compartment 704. In some embodiments, the ejector 904 may not unload the compartments 704 compartment 704 by compartment 704 rather, the ejector 904 may unload playing cards from the compartments 704 in a randomized (e.g., non-sequential) order. For example, the ejector 904 may unload one or more playing cards from a first compartment 704 without unloading other playing cards in the first compartment 704 and then may unload one or more playing cards from a second compartment 704 (e.g., with or without unloading other playing cards in the second compartment 704). In some embodiments, the ejector 904 may unload the playing cards one-at-a-time. In other embodiments, the ejector 904 may unload multiple playing cards at a time.

In some embodiments, the ejector 904 and the card transfer system 902 may be located at a top portion of the multi-compartment carousel 702. For example, the ejector 904 may unload playing cards into the card transfer system 902 when the compartment 704 retaining the playing cards is in a substantially vertical orientation within the multi-compartment carousel 702. In some embodiments, the ejector 904 and card transfer system 902 may be located about 90° of rotation about the axis of the multi-compartment carousel 702 from the first card feed system 402 (FIG. 6) such that the cards being unloaded from the compartments 704 are in an orientation transverse to an orientation of the cards when they are inserted into the compartments 704.

In some embodiments, the card transfer system 902 may include a plurality of rollers 906. The rollers 906 may displace playing cards from the multi-compartment carousel 702 to the card outlet 204 along the second card pathway 903. In some embodiments, the card transfer system 902 may include a packer arm 908. The packer arm 908 may include a packer arm pivot 910, an extended arm 912, and a finger 914. For example, the packer arm 908 may be driven by an eccentric packer motor 916 through a connecting link 918. The packer arm 908 may rotate about the packer arm pivot 910 translating the extended arm 912 and the finger 914 partially along the second card pathway 903. In some embodiments, the finger 914 may be configured to engage with a trailing edge of the playing cards to ensure proper loading of the playing cards into the card outlet 204.

The packer arm 908 may be used to provide additional force to a playing card along the second card pathway 903 as the playing card leaves the rollers 906. For example, the packer arm 908 may be located in the card-handling device 100 such that the finger 914 of the extended arm 912 of the packer arm 908 may abut against a trailing edge of a playing card and force the playing card at least substantially completely into the card outlet 204.

As depicted, the card outlet 204 may be configured to store the playing cards 205 in a similar orientation to the orientation in which the cards leave the card-shuffling apparatus 114. The card outlet 204 may be configured to store the playing cards in a substantially horizontal stack, such that the cards are in a vertical orientation (e.g., lateral or longitudinal edges of the cards extend in a substantially vertical direction) with each card stacked horizontally (e.g., where a height of the stack of cards is slanted to extend along a major length of the card output portion 112 in a direction along the top surface 108) next to an adjacent card with the major faces of the cards lying in a plane substantially transverse to the top surface 108. The card outlet 204 may be configured to substantially support the cards on at least two sides of the cards.

As depicted, the card outlet 204 may be configured to elevate and retract above and below the top surface 108 of the card-handling device 100. For example, the card outlet 204 may retract below the top surface 108 of the card-handling device 100 to be in closer proximity to the card-shuffling apparatus 114 while cards are transferred from the multi-compartment carousel 702 to the card outlet 204. In some embodiments, the card outlet 204 may be elevated above the top surface 108 of the card-handling device 100 when it has a complete set of one or more decks of cards (e.g., one, two, four, six, eight, ten decks of cards, etc.) that may be loaded in a card-dispending device, such as, a card shoe. In some embodiments, the card outlet 204 may be elevated above the top surface 108 of the card-handling device 100 when the operator needs to enter additional cards into gameplay, such as, to load the cards in a card shoe or to deal or draw cards individually or as a group of cards. In some embodiments, the card outlet 204 may remain in the elevated position above the top surface 108 of the card-handling device 100 until the cards have been removed from the card outlet 204.

Figure 10:
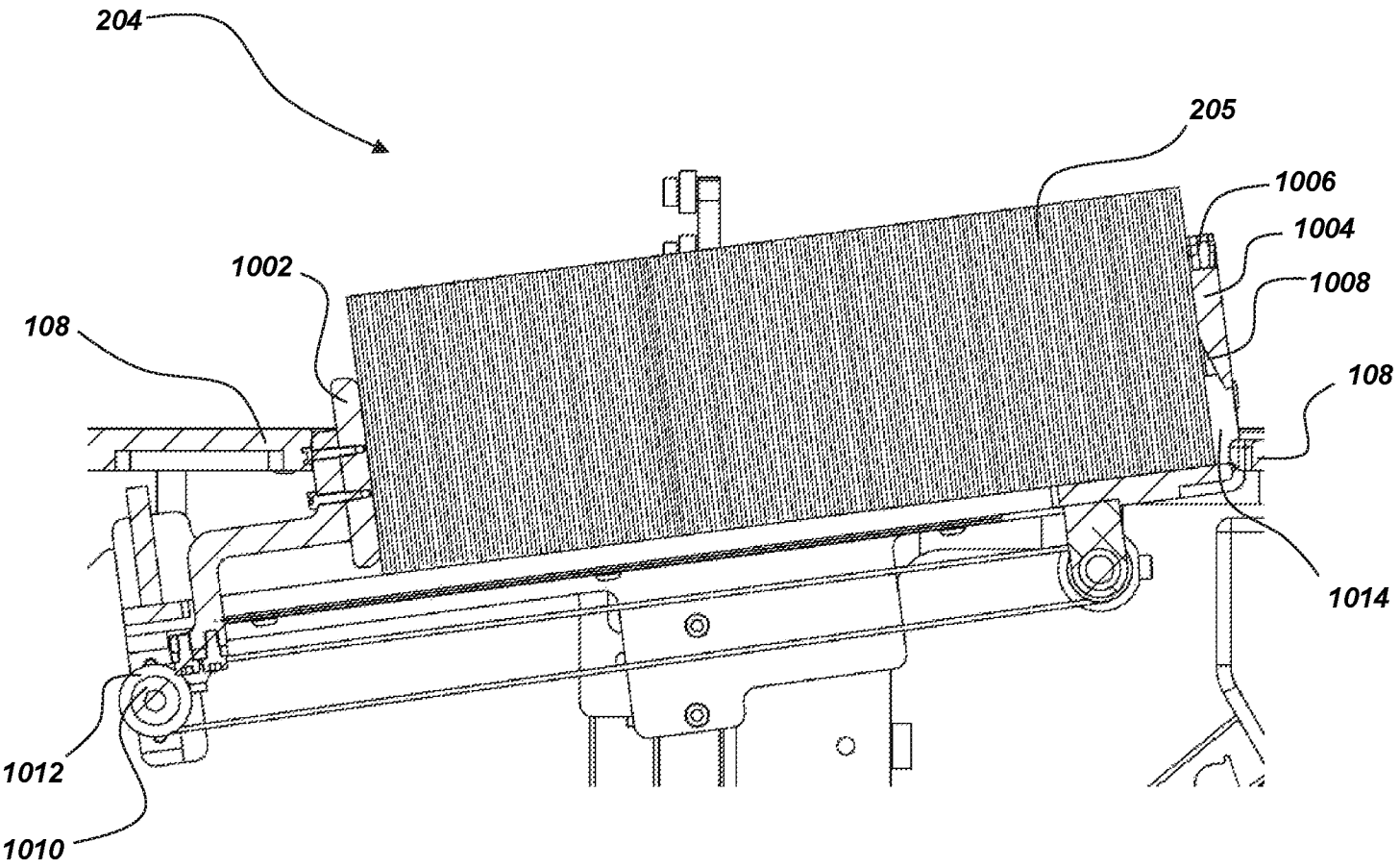
FIG. 10 shows an enlarged view of a section view of a card outlet storage container according to an embodiment of the present disclosure.

FIG. 10 shows a close-up view of the card outlet 204 of the card-handling device 100. In some embodiments, the card outlet 204 may be configured to hold up to six hundred fifty cards 205, such as between about fifty cards and about six hundred fifty cards, between about five hundred cards and six hundred cards, or about five hundred twenty cards (e.g., ten decks of cards).

In some embodiments, cards may be provided to the card outlet 204 (e.g., in the retracted position within the card-handling device 100 (FIG. 1)) by the card transfer system 902 (FIG. 9) may be added from an area below the card outlet 204. For example, a portion of the card outlet 204 (e.g., door or gate 1004) may define a card passage 1014 (e.g., opening, slot, etc.) in a lower portion of the gate 1004. The card passage 1014 may enable cards to pass through the card passage 1014 from the card transfer system 902 (FIG. 9) into the card outlet 204. In some embodiments, the gate 1004 may further define an angled surface 1008 configured to guide the cards being inserted through the card passage 1014 into the area within the card outlet 204. For example, the angled surface 1008 may provide a surface on which the card may slide to insert the card between a front area of the stack of playing cards 205 within the card outlet 204 and the gate 1004.

In some embodiments, the card outlet 204 may be configured to vary the internal volume of the card outlet 204. For example, the card outlet 204 may include a movable guide 1002. The movable guide 1002 may reduce the internal volume of the card outlet 204 when a number of cards to be placed in the card outlet 204 is, at least initially, less than the full capacity of the card outlet 204. The movable guide 1002 may be retracted to increase the internal volume of the card outlet 204 gradually as cards are loaded into the card outlet 204 to increase the capacity of the card outlet 204.

The card outlet 204 may be configured to present (e.g., release) a predetermined number of cards (e.g., all of the cards) to the operator such that the operator can withdraw (e.g., draw, slide, remove, etc.) the cards from the card outlet 204. For example, the card outlet 204 may include the movable guide 1002 and the gate 1004 on an end of the card outlet 204. In some embodiments, the gate 1004 may be configured to open a specified amount to enable a specific number of cards to be withdrawn past the gate 1004 (e.g., to enable an entirety of the cards 205 to slide over the gate 1004, which is substantially flush with the top surface 108 (FIG. 2) when in the open position). The gate 1004 may include a securing mechanism 1006 (e.g., a magnetic latch and a hinge) to secure the gate 1004 in place when cards are not being withdrawn. For example, a force provided by an operator sliding the cards 205 may overcome the magnetic latch and move the gate into the open, flush position. The operator may then continue sliding the cards 205 over the gate 1004 to the top surface 108 in order to further process the cards 205 (e.g., by cutting the decks of cards, moving the decks of cards into a shoe, etc.).

In some embodiments, the movable guide 1002 may be driven by a biasing element (e.g., a spring, compressible fluid, etc.). In some embodiments, the movable guide 1002 may be driven by a motor 1010. In some embodiments, the gate 1004 may displace to a position clear of a pathway (e.g., into recess 207 (FIG. 2)) upon which a stack of playing cards 205 travels to exit the card outlet 204. The motor may drive the movable guide 1002 a predetermined distance to push the cards 205 over the open gate 1004 to enable the operator to withdraw the cards. In some embodiments, where the cards 205 are removed in partial groups, the motor 1010 may act as a biasing element maintaining pressure on the movable guide 1002 such that when the gate 1004 opens and cards are withdrawn the movable guide 1002 moves the remaining cards into position for the next withdrawal.

In some embodiments, the motor 1010 may include a slip clutch 1012 (e.g., friction clutch, one way clutch, sprag clutch, freewheel clutch, overrunning clutch, etc.) to decrease fatigue on the motor 1010 and other components when running against the closed gate 1004. In some embodiments, the slip clutch 1012 may enable the movable guide 1002 to expand the internal volume of the card outlet 204 in response to additional cards being added by the card transfer system 506 (FIG. 5) without requiring the motor 1010 to drive the movable guide 1002 in the reverse direction.

Figure 11:
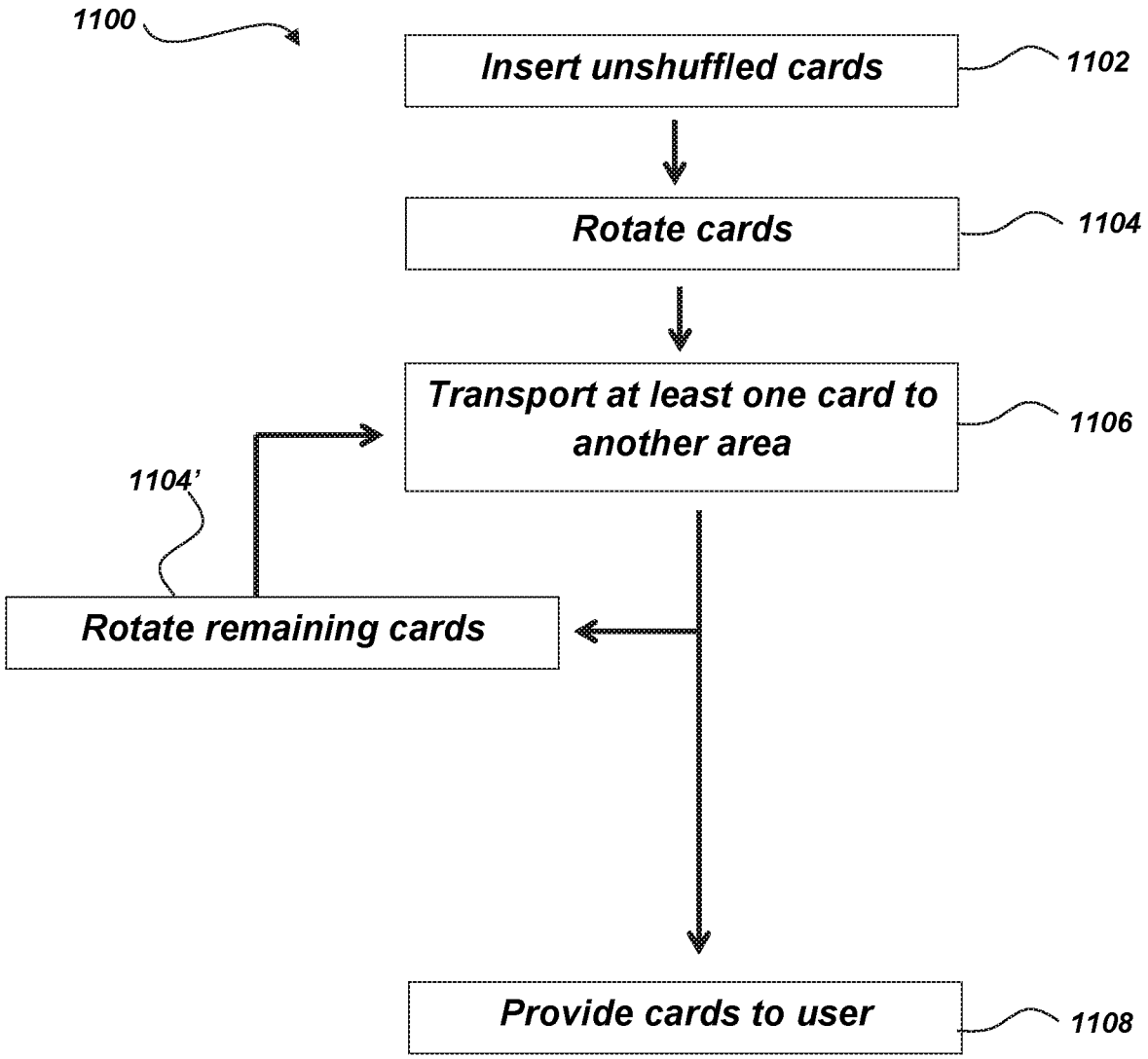
FIG. 11 is a process diagram for the shuffling of playing cards according to an embodiment of the present disclosure.

FIG. 11 shows a flow diagram of a process 1100 in which the card-handling device 100 may transport and shuffle playing cards. Referring to FIGS. 1 through 9 and 11 together, unshuffled playing cards may be loaded into the card intake area 202 of the card input portion 110 of the card-handling device 100, as represented in action 1102. The card intake area 202 may rotate the playing cards such that a lateral edge of the playing cards faces the card-shuffling apparatus 114, as represented in action 1104. The first card feed system 402 may transport at least one playing card from the card intake area 202 to another area (e.g., another portion of the card-handling device, another device, a randomizing mechanism or shuffler, etc.), as represented by action 1106. After the at least one playing card is removed from the card intake area 202, the card intake area 202 may rotate the playing cards at least 180° such that an opposite lateral edge of the playing cards is facing the first card feed system 402, as represented in action 1104'. After the card intake area 202 has rotated in action 1104', the first card feed system 402 may transport at least one more playing card from the card intake area 202 to the other area, as represented in action 1106. In some embodiments, the actions 1104, 1104', and 1106 may be repeated (e.g., with one card or multiple cards being transferred in each act) until there are no more playing cards in the card intake area 202. In some embodiments, the actions 1104, 1104', and 1106 may be repeated until the card intake area 202 has been emptied. In some embodiments, the actions 1104, 1104', and 1106 may be repeated until an operator enters a command in the control system 104 to stop the process. Once the playing cards have been transported the playing cards may be presented to the user (e.g., dealer), as represented in action 1108.

Figure 12:
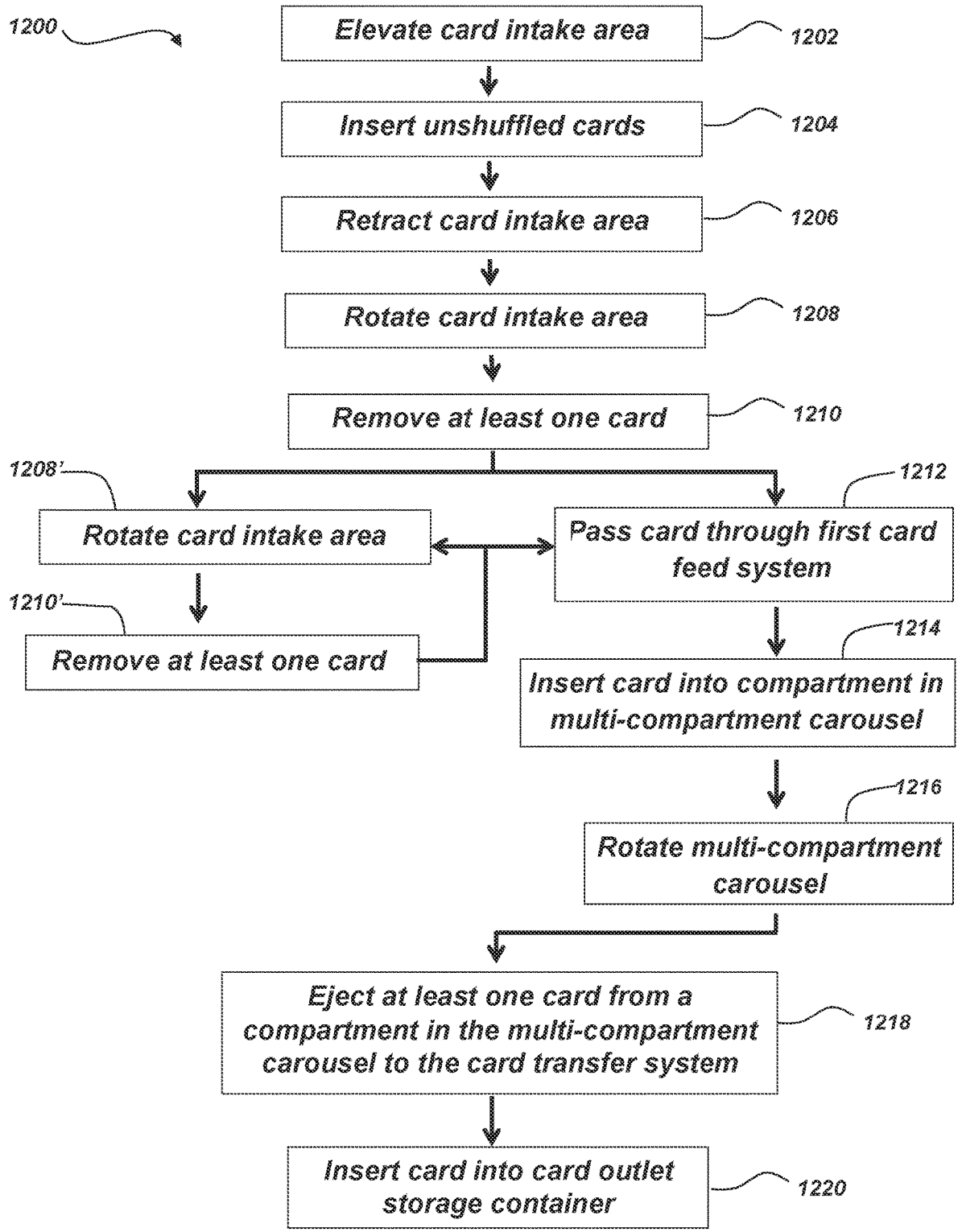
FIG. 12 is a process diagram for the shuffling of playing cards according to an embodiment of the present disclosure.

FIG. 12 shows a flow diagram of a process 1200 in which the card-handling device 100 may transport and shuffle playing cards. Referring to FIGS. 1 through 9 and 12 together, the card intake area 202 may be elevated above the top surface 108 of the card-handling device 100 to facilitate the loading of unshuffled cards, as represented in action 1202. The operator (e.g., dealer) may then load unshuffled cards into the card intake area 202, as represented by action 1204. In some embodiments, the operator may load unshuffled cards by decks (e.g., 52 cards at a time), or as an entire shoe (e.g., 2 decks, 4 decks, 6 decks, 8 decks, or 10 decks). After the unshuffled cards have been loaded into the card intake area 202, the card intake area 202 may be retracted below the top surface 108 of the card-handling device 100.

Once the card intake area 202 is fully retracted into the card-handling device 100, the card intake area 202 may rotate until a lateral edge of the playing cards is facing the multi-compartment carousel 702, as represented by action 1208. In other embodiments, the card intake area 202 may be retracted in a position where the lateral edge of the playing cards is facing the multi-compartment carousel 702 and may not need to be initially rotated before transferring one or more cards. Once a lateral edge of the playing cards is facing the multi-compartment carousel 702, the pick-off rollers 610 may remove at least one card from the card intake area 202, as represented in action 1210. The pick-off rollers 610 may transfer the removed card to the first card feed system 402, which may transport the at least one card from the card intake area 202 to the multi-compartment carousel 702, as represented in action 1212. The elongated packer arm 622 may move the at least one card from the first card feed system 402 into a compartment 704 of the multi-compartment carousel 702, as represented in action 1214. The multi-compartment carousel 702 may rotate moving the compartment 704 with at least one card in it to another location and presenting a new compartment 704 in the area of the elongated packer arm 622, as represented in action 1216. In some embodiments, the multi-compartment carousel 702 may rotate after each card is placed into a compartment 704. In some embodiments, the multi-compartment carousel 702 may only rotate after the compartment 704 is full. In some embodiments, the multi-compartment carousel 702 may rotate at random times (e.g., sometimes taking one card in each compartment 704 and other times taking more than one card in the compartment 704 before rotating). In some embodiments, the multi-compartment carousel 702 may rotate the same number of compartments 704 (e.g., 2 compartments, 3 compartments, etc.) during each rotation. In some embodiments, the control system 104 may randomize the number of compartments 704 that the multi-compartment carousel 702 rotates through each time it rotates.

After the at least one card is removed in action 1210, the card intake area 202 may rotate at least 180° such that the opposite lateral edge of the unshuffled cards is facing the multi-compartment carousel 702, as represented in action 1208'. After the card intake area 202 is rotated in action 1208', the pick-off rollers 610 may remove at least one card from the card intake area 202, as represented in action 1210'. The removed card may be transported through the first card feed system 402 and be inserted into a compartment 704 of the multi-compartment carousel 702, as represented in actions 1212 and 1214. The multi-compartment carousel 702 may continue to rotate as described above and represented in 1216. This process may continue to repeat until there are no more cards in the card intake area 202, until a preselected is reached, or until the operator enters a command to stop the process. Such a process may enable an operator to randomize (e.g., intermittently alter, sporadically alter) which lateral edge of the cards is presented on one side of a stack (e.g., deck(s)) of cards.

The ejector 904 may eject the cards from the compartments 704 of the multi-compartment carousel 702 into the card transfer system 902, as represented in action 1218. The card transfer system 902 may transfer the card to the card outlet 204, as represented in action 1220. The cards may be inserted into the card outlet 204 with major faces of the cards aligned at least partially in a substantially vertical plane (e.g., transverse to the top surface 108 of the card-handling device 100, where the stack of cards is tipped over primarily extending in a horizontal or lateral plane). In some embodiments, the card outlet 204 may be positioned above the top surface 108 of the card-handling device 100. In some embodiments, the card outlet 204 may elevate and retract similar to the card intake area 202. For example, the card outlet 204 may be in a retracted position when the cards are inserted into the card outlet 204 in action 1220. In some embodiments, the card outlet 204 may be elevated above the top surface 108 of the card-handling device 100 when the card outlet 204 is full to facilitate access to the shuffled cards 205 by the operator. In some embodiments, the card outlet 204 may elevate once a specified number of cards are inserted into the card outlet 204. In some embodiments, the card outlet 204 may remain in the retracted position until the operator enters a command into the control system 104 to call the card outlet 204 to the area above the top surface 108 of the card-handling device 100.

The embodiments of the present disclosure may facilitate implementation and practice of card games using larger numbers of cards than is conventionally possible without undesirably delaying game play. For example, the embodiments of the present disclosure may allow for the card games using more than eight decks of cards, such as, for example, ten decks of cards, or twelve decks of cards. Embodiments of the card-handling devices may also facilitate simple repair and replacement of wear parts of the card-handling device, such as, for example, compartment modules of the multi-compartment carousel, roller, imaging devices, and sensors by enabling access to these components that can be removed (e.g., where select groups of compartments of the carousel may be individually removed and repaired or replaced).

The embodiments of the present disclosure may reduce and/or eliminate the effectiveness of some forms of card counting. For example, embodiments of the present disclosure may reduce or eliminate the effectiveness of card counting methods involving edge sorting by randomizing the orientation of the lateral edges of the cards within the card-handling device.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. A card-handling device, comprising:

a playing card-shuffling apparatus; and a card rotation device configured to rotate one or more playing cards about a minor axis of the one or more playing cards to randomly alter an orientation of lateral edges of the one or more playing cards, the minor axis of the one or more playing cards extending through a thickness of the one or more playing cards in a direction transverse to a longitudinal axis and a lateral axis of the one or more playing cards as at least one of the one or more playing cards enters the playing card-shuffling apparatus.

2. The card-handling device of claim 1, wherein the card rotation device comprises a card input of the card-handling device.

3. The card-handling device of claim 1, wherein the card-handling device is configured to position the card rotation device in a first orientation with first lateral edges of the one or more playing cards facing the playing card-shuffling apparatus and a second orientation with second lateral edges of the one or more playing cards facing the playing card-shuffling apparatus, the first lateral edges opposing the second lateral edges.

4. The card-handling device of claim 3, wherein the first lateral edges and the second lateral edges extend along longitudinal axes of the one or more playing cards.

5. The card-handling device of claim 3, wherein the second orientation is approximately 180° of rotation different from the first orientation.

6. The card-handling device of claim 3, further comprising an actuation system associated with the card rotation device and a frame structure of the card-handling device, the actuation system configured to move the card rotation device between the first orientation and the second orientation.

7. The card-handling device of claim 6, wherein the actuation system is configured to automatically rotate the card rotation device approximately 180° between the second orientation and the first orientation.

8. The card-handling device of claim 1, further comprising a card output comprising a card output area configured to receive playing cards from the playing card-shuffling apparatus, wherein the card output is configured to present the playing cards in a horizontal orientation with major faces of the playing cards extending a direction transverse to a gaming surface on which the card-handling device is utilized.

9. The card-handling device of claim 8, wherein the playing card-shuffling apparatus comprises a carousel configured to receive and eject the playing cards from a number of compartments arranged radially about the carousel.

10. The card-handling device of claim 9, wherein the number of compartments comprise at least 100 compartments.

11. The card-handling device of claim 9, wherein the carousel comprises compartment modules each comprising at least two compartments, wherein each compartment module is configured to be individually removed from and positioned in the carousel, the compartment modules collectively comprising the number of compartments.

12. The card-handling device of claim 11, wherein the compartment modules each comprise at least four compartments and less than ten compartments.

13. The card-handling device of claim 11, wherein the carousel is configured to receive the playing cards from the card rotation device in a compartment at a first position and eject the playing cards from the compartment into the card output area at a second position, wherein the second position is approximately 90° of rotation from the first position.

14. The card-handling device of claim 13, wherein the playing cards are received into the card output area in an orientation substantially transverse to an orientation in which the playing cards are received into the card-handling device in a card input of the card-handling device.

15. A card-handling device, comprising:

a card input configured to rotate at least one playing card of a group of playing cards about a minor axis of the at least one playing card to alter an orientation of lateral edges of the at least one playing card relative to at least one adjacent playing card of the group of playing cards, the minor axis of the at least one playing card extending through a thickness of the at least one playing card in a direction transverse to a longitudinal axis and a lateral axis of the at least one playing card, wherein the card input is configured to enable the at least one playing card to be provided to a card-shuffling apparatus for shuffling playing cards after the orientation of the lateral edges of the at least one playing card has been altered.

16. A card-handling device configured to be mounted at or proximate a gaming surface, the card-handling device comprising:

a card-shuffling apparatus for shuffling playing cards; and a card rotation device configured to receive the playing cards in a substantially flat orientation and to alter an orientation of a leading edge of at least some, but not all, of the playing cards while maintaining the at least some of the playing cards in the substantially flat orientation.

17. The card-handling device of claim 16, wherein the card-handling device is configured to transfer the playing cards to the card-shuffling apparatus after the orientation of the leading edge of at least some of the cards have been altered by the card rotation device.

18. The card-handling device of claim 16, further comprising a card output area for receiving the playing cards from an output of the card-shuffling apparatus, wherein the card output area is configured to receive and store the playing cards in an orientation where major faces of the playing cards are substantially transverse to the gaming surface.

19. The card-handling device of claim 18, wherein the card output area is configured to hold between five hundred and six hundred playing cards in a single stack where the playing cards are substantially supported on sides of each of the playing cards.

20. The card-handling device of claim 16, wherein the card rotation device comprises:

a rotating elevator configured to receive the playing cards with major faces of the playing cards in a plane substantially parallel to the gaming surface and rotate the playing cards at least 90° in the plane substantially parallel to the gaming surface, and transport the playing cards from a first position above the card-handling device to a second position within the card-handling device;

a first card feed system for transporting the playing cards from the rotating elevator in an area below the gaming surface to the card-shuffling apparatus, the first card feed system comprising a first card pathway; and an imaging system oriented along the first card pathway of the first card feed system configured to read at least one indicia of the playing cards being transported along the first card pathway of the first card feed system.

21. A method of shuffling cards, comprising:

inputting cards into a card rotation device of a card-handling device;

rotating the card rotation device from a first orientation to a second orientation about a minor axis of the cards to alter an orientation of lateral edges of the cards, the minor axis of the cards extending through a thickness of the cards in a direction transverse to a longitudinal axis and a lateral axis of the cards to randomize an orientation of the lateral edges of the cards;

transporting the cards from the card rotation device into a card-shuffling apparatus; and outputting at least one card from the card-shuffling apparatus into a card output area.

22. The method of claim 21, further comprising transporting at least one card from the card rotation device when the card rotation device is in the second orientation.

23. The method of claim 21, wherein rotating the card rotation device from the first orientation to the second orientation comprises rotating the card rotation device about 180°.

24. The method of claim 21, further comprising inputting the cards into the card rotation device in a first plane and outputting the at least one card into the card output area in a second plane where the second plane is substantially perpendicular to the first plane.

25. A card-shuffling carousel comprising:

compartments configured to hold at least one card arranged radially about the card-shuffling carousel, wherein the compartments comprise:

an aperture defined by at least two arms; and a resilient material extending between a bottom retention and a top retention in at least one of the at least two arms, wherein the resilient material has a length greater than a distance between the bottom retention and the top retention and at least one of the bottom retention or the top retention comprises a movable connection.

26. The card-shuffling carousel of claim 25, wherein the resilient material is fixed to at least one of the top retention and the bottom retention.

* * * * *